US009685709B2

(12) United States Patent
Sabbadini et al.

(10) Patent No.: US 9,685,709 B2
(45) Date of Patent: Jun. 20, 2017

(54) METHOD FOR DESIGNING A MODULATED METASURFACE ANTENNA STRUCTURE

(71) Applicant: European Space Agency, Paris (FR)

(72) Inventors: Marco Sabbadini, Leiden (NL); Gabriele Minatti, Bagno a Ripoli (IT); Stefano Maci, Florence (IT); Paolo Patrizio De Vita, Pisa (IT)

(73) Assignee: European Space Agency, Paris (FR)

( * ) Notice: Subject to any disclaimer, the term of this patent is extended or adjusted under 35 U.S.C. 154(b) by 0 days.

(21) Appl. No.: 15/104,866

(22) PCT Filed: Dec. 16, 2013

(86) PCT No.: PCT/EP2013/076724
§ 371 (c)(1),
(2) Date: Jun. 15, 2016

(87) PCT Pub. No.: WO2015/090351
PCT Pub. Date: Jun. 25, 2015

(65) Prior Publication Data
US 2017/0018855 A1 Jan. 19, 2017

(51) Int. Cl.
*H01Q 15/00* (2006.01)
*H01Q 21/24* (2006.01)

(52) U.S. Cl.
CPC ..... *H01Q 15/0066* (2013.01); *H01Q 15/00* (2013.01); *H01Q 21/24* (2013.01)

(58) Field of Classification Search
None
See application file for complete search history.

(56) References Cited

U.S. PATENT DOCUMENTS

| | | | |
|---|---|---|---|
| 6,552,696 | B1 | 4/2003 | Sievenpiper et al. |
| 7,911,407 | B1 | 3/2011 | Fong et al. |
| 2010/0066629 | A1 | 3/2010 | Sievenpiper |

OTHER PUBLICATIONS

Sievenpiper, D. F. at al., "Two-Dimensional Beam Steering Using an Electrically Tunable Impedance Surface", IEEE AP, vol. 51, Iss. 10, 2003, 2713-2722.

(Continued)

*Primary Examiner* — Robert Karacsony
(74) *Attorney, Agent, or Firm* — Seed IP Law Group LLP

(57) ABSTRACT

A method for designing a surface pattern for an impedance surface which results in a position-dependent target impedance of said impedance surface, and the impedance surface having the position-dependent target impedance radiates a desired first-type electromagnetic field radiation in reaction to being irradiated by a second-type electromagnetic field radiation. The method includes obtaining a first modal representation on the basis of the first-type electromagnetic field radiation in terms of a set of base modes that are chosen in accordance with a model function of the position-dependent target impedance, and obtaining a second modal representation on the basis of the second-type electromagnetic field radiation and the model function in terms of the set of base modes. The method further includes obtaining a first position-dependent quantity indicative of the position-dependent target impedance on the basis of the first modal representation and the second modal representation by determining values for a plurality of parameters of the model function for maximizing an overlap between the first modal representation and the second modal representation, and obtaining, as the surface pattern, a second position-dependent quantity indicative of geometric characteristics of the impedance surface on the basis of the first position-dependent quantity and a relationship between geometric charac- (Continued)

teristics of the impedance surface and corresponding impedance values.

17 Claims, 10 Drawing Sheets

(56) References Cited

OTHER PUBLICATIONS

Sievenpiper, D. F. at al., "Holographic Artificial Impedance Surfaces for Conformal Antennas", IEEE APS/URSI Symposium, Washington, DC, Jul. 2005.
Fusco, V.F. et al., "2-D Anisotropic Textured Surfaces: Properties and Advanced Antenna Applications", invited paper to EuCAP 2007, Edinburgh, UK, Nov. 2007.
Minatti, G. et al., "Spiral Leaky-Wave Antennas Based on Modulated Surface Impedance", IEEE Trans. Antennas and Propagation, vol. 59, No. 12, pp. 4436-4444, Dec. 2011 (Minatti et al. 2011).
Minatti, G. et al., "A Circularly-Polarized Isoflux Antenna Based on Anisotropic Metasurface", IEEE Trans. Antennas and Propagation, vol. 60, No. 11, pp. 4998-5009, Nov. 2012 (Minatti et al. 2012).
International Search Report for PCT/EP2013/076724, mailing date Aug. 27, 2014, 7 pgs.

METHOD FOR DESIGNING A MODULATED METASURFACE ANTENNA STRUCTURE

BACKGROUND

Technical Field

The present application relates to a method for designing a modulated metasurface antenna. More particularly, the present application relates to designing a surface pattern for a modulated metasurface antenna, i.e., to designing a surface pattern for an impedance surface which, if provided on said impedance surface, results in a position-dependent target impedance of said impedance surface, and the impedance surface having the position-dependent target impedance radiates a desired electromagnetic field radiation in reaction to being irradiated by given electromagnetic field radiation. The present application further relates to an impedance surface having a surface pattern designed by the inventive method and to an antenna provided with an impedance surface having a surface pattern designed by the inventive method.

The disclosure in the present application is particularly though not exclusively applicable to designing impedance surfaces for modulated metasurface antennas for telecommunication applications, space transportation, sensors and remote sensing, medical applications, surveillance, etc., and especially for modulated metasurface antennas for low earth orbit (LEO) satellite platforms.

Description of the Related Art

The main goal of conventional antenna design is to shape an electromagnetic guiding and scattering structure so as to obtain a desired radiation pattern over a given bandwidth. The main limitations of the conventional approach are that the guiding and scattering properties of the materials used in the design are generally input parameters of the design procedure. As a result, the range of antenna configurations and performances that are achievable in the context of conventional antenna design is limited.

As an example of a conventional antenna, a smooth-walled circular wave guide horn may be considered. To improve the radiation pattern and to enlarge the bandwidth of the antenna, it is possible to use corrugated walls. This however leads to a much bulkier structure which is also rather complex and expensive to manufacture. At the same time, the control afforded by the corrugated walls is limited by the fact that it is only known in the prior art how to design an axially symmetric structure with radial corrugations and a longitudinal modulation of width an depth, or an axially symmetric structure with axial corrugations and a radial modulation.

The use of artificial modulated surfaces (metasurfaces) allows for a radical departure from the conventional design procedure by providing extensive control of the impedance or scattering characteristics of the surface, however, at the cost of a rather complex design procedure.

In the above example, a metasurface could be used to replace the corrugated walls of the horn. This would result in a much more compact and lighter structure, which is also easier and less expensive to manufacture. Moreover, the possibility of designing the metasurface with both azimuthal and longitudinal variations offers significantly improved control of the horn behavior and performance.

The use of metasurfaces in antennas is known in the prior art for various goals and for various applications as proposed, e.g., in Sievenpiper, D. F. at al., "Two-Dimensional Beam Steering Using an Electrically Tunable Impedance Surface", IEEE AP, Vol. 51, Iss. 10, 2003, 2713 - 2722, or in Fusco, V.F. et al., "2-D Anisotropic Textured Surfaces: Properties and Advanced Antenna Applications", invited paper to EuCAP 2007, Edinburgh, UK, November 2007.

However, the above examples of applications of metasurfaces in the prior art are limited to small antennas and do not feature any modulation of the metasurface itself. The main reason for these limitations is a lack of a robust design procedure for the modulation of the metasurface. Evidently, such design procedure would have to provide sub-wavelength control of the metasurface over several (tens or hundreds) square wavelengths of antenna aperture, taking into account tens of thousands of potentially independent parameters defining the detailed layout of the metasurface.

Recent attempts to address this issue are reported, e.g., in Sievenpiper, D. F. at al., "Holographic Artificial Impedance Surfaces for Conformal Antennas", IEEE APS/URSI Symposium, Washington, D.C., July 2005, in Minatti, G. et al., "Spiral Leaky-Wave Antennas Based on Modulated Surface Impedance", IEEE Trans. Antennas and Propagation, Vol. 59, No. 12, pp. 4436 4444, December 2011 (Minatti et al. 2011), or in Minatti, G. et al., "A Circularly-Polarized Isoflux Antenna Based on Anisotropic Metasurface", IEEE Trans. Antennas and Propagation, Vol. 60, No. 11, pp. 4998 5009, November 2012 (Minatti et al. 2012).

In this context, a metasurface can be defined as a scattering surface that is characterized by a modulation of its scattering tensor. Known implementations of such metasurfaces are based on a dielectric slab backed by a metal plate or having a metalized back surface, having either a thickness that varies across the surface or a pattern of printed metallic patches obtained by repetition (tiling) of a basic sub-wavelength cell, with dimensions and/or orientations of the printed metallic patches changing smoothly across the surface. The modulation of the metasurface controls the conversion of an electromagnetic wave launched on the metasurface (surface wave) into a radiating wave (commonly referred to as leaky-wave). Therein, the specific design of the modulation controls the leakage rate, and thus the antenna beam orientation and shape.

According to a further one of such approaches, which is reported in U.S. Pat. No. 7,911,407 B1 to Fong, B. H. L. et al., a tensorial surface impedance is determined by calculating an outer product between a projection of a desired field pattern on the impedance surface and a surface current on the impedance surface generated by a feed. The tensorial surface impedance is then implemented by patterning the impedance surface with metallic patches, each of the patches being characterized by geometric parameters g, $g_s$, $a_s$. A table linking the geometric parameters to values of an impedance tensor of the respective metallic patch is experimentally determined beforehand by providing a sample artificial impedance surface comprised of patches having a given set of parameters, and measuring impedance values for wave propagation along different directions of the sample impedance surface. Providing sample impedance surfaces for several sets of geometric parameters and performing the aforementioned measurements results in said table linking the geometric parameters to values of an impedance tensor. By referring to the table, geometric parameters for each metallic patch on the impedance surface are determined on the basis of local surface impedance at the position of the respective patch, in accordance with the calculated tensorial impedance.

Thus, this prior art approach performs the synthesis of fields (field matching) on the impedance surface, resorting to the well-known properties of surface waves on modulated impedance surfaces. One of the main limitations of this approach lies in the fact that the field matching on the impedance surface makes it difficult to control complex radiation pattern cases as well as complex modulation patterns.

In consequence, this prior art approach does not provide direct feedback on options concerning patch design. Thus, if it is desired to use a different patch design, this different patch design has to be implemented by trial and error. As it further turns out, the approach does not offer measures for avoiding undesired discontinuities that occur in the surface currents (mainly in the phase thereof) and thus occur also in the derivative of the tensorial surface impedance. Lastly, the approach has a limited allowance for performing an optimum selection of the geometric parameters of the patches. For instance, several sets of such geometric parameters may result in the same tensorial surface impedance, while the resulting impedance surfaces would differ in other aspects, such as smoothness of the derivative of the wavevector. Accordingly, the approach does not allow for satisfying secondary requirements such as smoothness of the derivative of the wavevector, which could contribute to minimizing modal conversion and thus to improving the behavior of the impedance surface.

All of the above prior art approaches to designing the modulation of a metasurface are limited in that they are particularly adapted to a particular type of surface structure, e.g., a particular type of printed metal patch, to a design of the feed producing the electromagnetic wave launched on the metasurface, and moreover require knowledge of the desired electromagnetic field projected on the metasurface. Modulation patterns that are obtainable by the above prior art approaches are rather limited, and more complex modulation patterns going beyond, e.g., a sine or cosine dependence of the modulation are not feasible. Moreover, as indicated above also the complexity of radiated fields both with regard to spatial variation and polarization is limited.

Summarizing, presently known design procedures for metasurfaces are specific to the particular implementation of the metasurface and moreover offer little flexibility in adapting to different requirements. Since the range of obtainable modulation patterns is limited, in principle also the range of configurations of the antenna beams scattered by the respective metasurfaces is limited to rather simple configurations, especially with regard to polarization and/or angular variation of the antenna beam.

BRIEF SUMMARY

Embodiments of the present application are designed to overcome the limitations of the prior art discussed above. Embodiments of the present application provide a flexible method for designing a metasurface. Embodiments of the present application also provide a method for designing a metasurface that is applicable to generic desired antenna beams. Further, embodiments of the present application provide a method for designing a metasurface that provides control of a polarization of the antenna beam. Additionally, embodiments of the present application provide a method for designing a metasurface that allows designing metasurfaces for general antenna geometries and feed arrangements.

The present application thus proposes a method for designing a surface pattern for an impedance surface having the features of claim 1. Preferred embodiments of the application are described in the dependent claims.

According to an aspect of the present application, a method for designing a surface pattern for an impedance surface which, if provided on said impedance surface, results in a position-dependent target impedance of said impedance surface, and the impedance surface having the position-dependent target impedance radiates a desired first-type electromagnetic field radiation in reaction to being irradiated by a second-type electromagnetic field radiation, comprises: obtaining a first modal representation on the basis of the first-type electromagnetic field radiation in terms of a set of base modes that are chosen in accordance with a model function of the position-dependent target impedance, obtaining a second modal representation on the basis of the second-type electromagnetic field radiation and the model function in terms of the set of base modes, obtaining a first position-dependent quantity indicative of the position-dependent target impedance on the basis of the first modal representation and the second modal representation by determining values for a plurality of parameters of the model function for maximizing an overlap between the first modal representation and the second modal representation, and obtaining, as the surface pattern, a second position-dependent quantity indicative of geometric characteristics of the impedance surface on the basis of the first position-dependent dependent quantity and a relationship between geometric characteristics of the impedance surface and corresponding impedance values.

The above inventive method allows determining an appropriate surface pattern for any desired first-type electromagnetic field radiation (antenna beam) having a desired polarization, for any kind of suitable second-type electromagnetic field radiation (incident field or exciter field). In particular, both the surface shape (curvature and form) and the exciter field can be chosen in accordance with external constraints on the antenna design or individual design preferences. Moreover, it is not necessary to work with a projection of the desired antenna beam onto the impedance surface. Thus, the inventive method offers a significant improvement in flexibility compared to prior art methods and is applicable to designing metasurfaces for a wide field of applications, such as telecommunication applications, space transportation, sensors and remote sensing, medical applications, surveillance, etc.

In addition, the inventive method is not limited to a particular choice of surface pattern, i.e., to a particular choice of implementation of the position-dependent target impedance. In other words, the inventive method is not specifically adapted to, e.g., a particular choice of a basic cell comprising a printed metallic patch. Rather, using the first position-dependent quantity indicative of the position-dependent target impedance, the final impedance pattern may be realized using any kind of surface structure, in particular any kind of basic cell used for tiling of the impedance surface. Thus, it is possible to use different types of basic cells simultaneously when implementing the impedance surface. This implies that also the material forming the surface does not need to be initially fixed. Rather, using the first position-dependent quantity indicative of the position-dependent target impedance, the impedance surface can be implemented for any type of surface, choosing, e.g., tiling by appropriate basic cells or other appropriate means of implementing the position-dependent target impedance, also in combinations. Consequently, also with regard to the choice of the implementation of the surface pattern, the inventive method allows for observance of external constraints on the antenna design or individual design preferences.

It is also to be noted that the inventive method allows for full control of the polarization of the antenna beam. Thus, antennas scattering, e.g., antenna beams having circular polarization can be designed in a convenient and efficient manner. In general, it can be said that the use of the full-wave formulation by embodiments of the present application allows for covering also configurations that are beyond the reach of the prior art, such as high-leakage structures, multi-mode structures, 3D structures, and structures displaying an intimate mix of different cell types.

Lastly, the modular structure of the inventive method allows for simple extension and further improvements without compromising the underlying logic and its advantages as regards, e.g., accuracy and speed.

In the above, the base modes may be mutually orthogonal or orthonormal base modes.

Preferably, obtaining the first position-dependent quantity comprises calculating a reaction integral of the first-type electromagnetic field radiation and a third-type electromagnetic field radiation, that would be radiated by an impedance surface having a position-dependent impedance in accordance with the model function and being irradiated by the second-type electromagnetic field radiation, and maximizing the reaction integral.

The method may further comprise a step of partitioning the impedance surface into a plurality of elements of area, wherein the relationship between geometric characteristics of the impedance surface and corresponding impedance values is a relationship between geometric characteristics of the elements of area and corresponding impedance values, and wherein obtaining the second position-dependent quantity comprises, for each of the plurality of elements of area, obtaining geometric characteristics of the element of area on the basis of the first position-dependent quantity and the relationship between geometric characteristics of the elements of area and the corresponding impedance values.

By discretizing the impedance surface, a computational effort required for executing the inventive method can be reduced. Moreover, discretizing the impedance surface allows for a choice among a plurality of different surface structures (basic cells), in accordance with limitations imposed by the manufacture of the impedance surface or by other specific requirements.

Preferably, the method further comprises determining the set of base modes so that each of the base modes may propagate on the impedance surface if the impedance surface is provided with a position-dependent impedance in accordance with the model function.

Further preferably, obtaining the first modal representation includes decomposing the first-type electromagnetic field radiation into a plurality of first modes, wherein each of the plurality of first modes corresponds to a respective one of the set of base modes, and obtaining the second modal representation includes decomposing the third-type electromagnetic field radiation into a plurality of second modes, wherein each of the plurality of second modes corresponds to a respective one of the set of base modes.

Yet further preferably, obtaining the first position-dependent quantity comprises, for each of the set of base modes for which a corresponding first mode in the plurality of first modes and a corresponding second mode in the plurality of second modes exists, calculating an outer product between the corresponding first mode and the corresponding second mode.

Working with the first and second modal representations as defined above, the first position-dependent quantity indicative of the position-dependent target impedance can be obtained in a particularly simple and efficient manner.

Preferably, one of the plurality of parameters of the model function relates to a period of spatial modulation of the position-dependent target impedance on the impedance surface. Further preferably, another one of the plurality of parameters of the model function relates to an average impedance on the impedance surface.

Thereby, any desired modulation of the target impedance, that may be chosen in accordance with, e.g., properties of the material in which the impedance surface is to be implemented or in accordance with a symmetry of the desired antenna beam, can be realized.

Therein, the model function of the position-dependent target impedance may relate to a decomposition of the position-dependent target impedance into a plurality of terms, each relating to a Spline wavelet. Alternatively, the model function of the position-dependent target impedance may relate to a de-composition of the position-dependent target impedance into a plurality of products of Spline wavelets and phase factors.

Such choices of the model function offer a significant improvement in flexibility as regards the position-dependent target impedance compared to the prior art, in which only basic modulation patterns, such as sine or cosine modulation patterns have been available.

In the inventive method, it is preferred that the position-dependent target impedance is of tensorial type.

Further, the inventive method allows for obtaining a first-type electromagnetic field radiation that is circularly polarized. Yet further, the second-type electromagnetic field radiation may be anisotropic with respect to a center of the impedance surface.

Preferably, the geometric characteristics of at least a subgroup of the plurality of elements of area respectively relate to a configuration of a conducting structure of predetermined shape provided on a dielectric material. Alternatively or in addition, the geometric characteristics of at least a subgroup of the plurality of elements of area respectively relate to a thickness of a dielectric material. Alternatively or in addition, the geometric characteristics of at least a subgroup of the plurality of elements of area respectively relate to a configuration of one or more openings in a metal layer. Alternatively, the geometric characteristics of the impedance surface may relate to a thickness of a dielectric material.

The above configurations provide convenient implementations for providing the impedance pattern with the position-dependent target impedance.

It is foreseen that the inventive method further comprises a step of providing the impedance surface with the determined surface pattern.

A particular advantage is achieved if the method further comprises comparing the first-type electromagnetic field radiation to a fourth-type electromagnetic field radiation would be radiated by the impedance surface provided with the determined surface pattern in reaction to being irradiated by the second-type electromagnetic field radiation, adjusting at least one of the model function of the position-dependent target impedance and the second-type electromagnetic field radiation, and repeating the steps defined above to obtain an adjusted surface pattern.

Although it has been found by the inventors that already a single iteration of the inventive method in almost all cases results in satisfactory results, the performance of the impedance surface may be even more closely matched to the desired performance by adjusting either one of the model function and the second-type electromagnetic field ratio and repeating the steps of the inventive method.

A further aspect of the present application relates to an impedance surface having a surface pattern obtainable by the inventive method. A yet further aspect of the present application relates to an antenna provided with an impedance surface having a surface pattern obtainable by the inventive method.

BRIEF DESCRIPTION OF THE SEVERAL VIEWS OF THE DRAWINGS

Aspects of the invention are described below in an exemplary manner making reference to the accompanying drawings, of which

DETAILED DESCRIPTION

Figure 1:
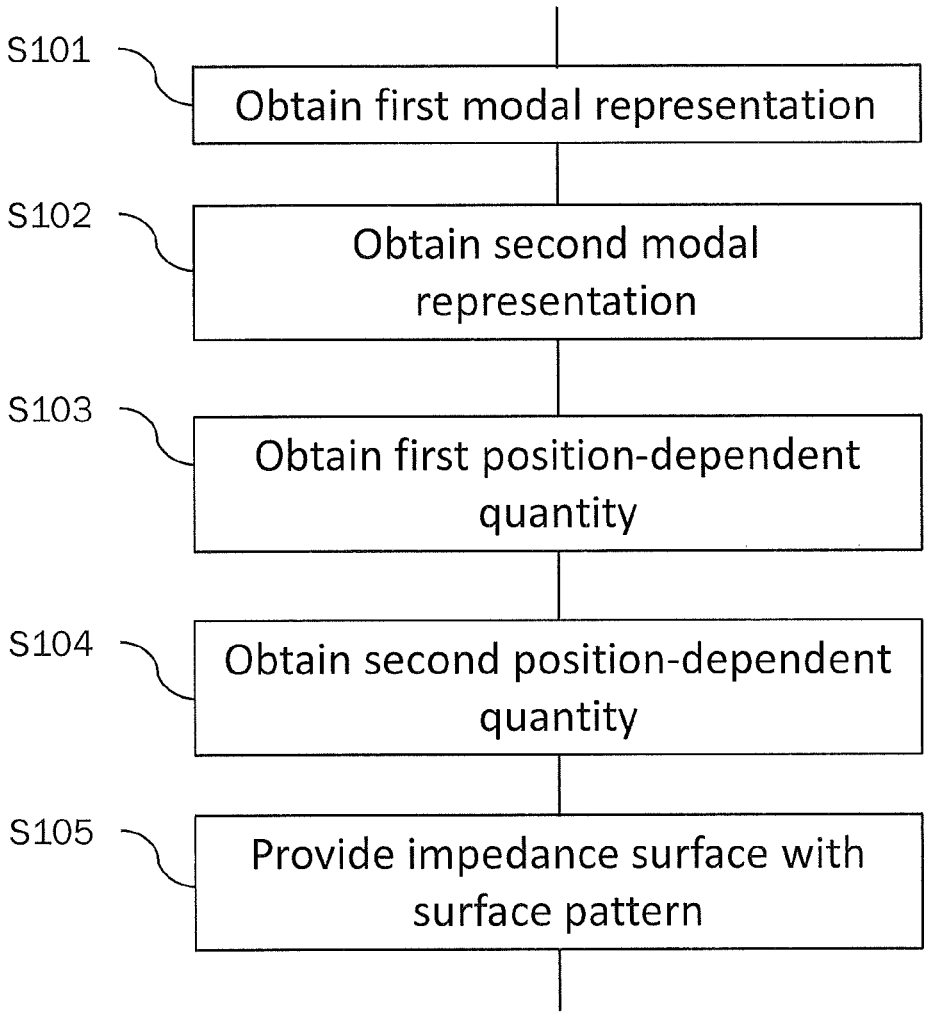
FIG. 1 is a flow chart illustrating a method for designing a surface pattern for an impedance surface according to the present application.

Preferred embodiments of the present application will be described in the following with reference to the accompanying figures, wherein in the figures, identical objects are indicated by identical reference numbers. It is understood that the present application shall not be limited to the described embodiments, and that the described features and aspects of the embodiments may be modified or combined to form further embodiments of the present application.

The present application relates to a conjugate-matched design procedure for obtaining artificial surface antennas with modulated scattering tensor (modulated impedance tensor).

In the context of the present application, modulated metasurface antennas are based on the use of a special type of scattering surfaces characterized by a modulation of their scattering tensor. The surface, which can be flat or curved or faceted, is illuminated by one or more feeding elements (either embedded or external). Several surfaces can be combined to achieve the desired result. In the framework of the present description, terms such as "metasurface" and "modulated surface" are used synonymously.

Metasurfaces exploit the interaction of electromagnetic waves with conductors, dielectrics, and their combinations shaped and arranged in such a way to obtain discrete or continuous patterns across the surface, with variations starting at sub-wavelength scale. The local interaction of an incident wave with the structured material controls its scattering. The field emerging after interaction is the result of a Huygens-like recombination of the local contributions. All Stoke's parameters can be controlled within a wide range across the emerging wave front. Thus amplitude, phase and polarization can be changed according to needs and within boundaries related to the specific implementation. The emerging wave may travel in the positive (forward) of negative (backward) direction compared with the incident one, as seen from the local tangent plane.

Metasurfaces that have been designed according to the inventive method can be realized in different ways, wherein both reflective and translucent metasurfaces can be used. A reflective one has a structure backed by a metal plate conformal to it or has a metalized back surface. A first way of realizing a metasurface is by modulating the thickness of a dielectric slab. A second option is by embedding one or more metal layers within the dielectric, each characterized by a pattern obtained by the repetition (tiling) of a basic sub-wavelength cell, according to a selected reference geometry (square, triangular, hexagonal, circular, etc.) with dimensions and orientation changing smoothly across the surface.

The grid underlying the pattern may also be non-uniform across the surface, e.g., the pattern can be sparse. One, possibly the only, layer can be on the front dielectric surface. Further possible implementations include metallic elements perpendicular to the surface, a (discrete) modulation of the dielectric constant across the surface (e.g., by using interwoven patterns of dielectrics with different constants or by filling honeycomb cells with powders of different dielectric constants), a metal-only structure with 3D sub-wavelength features and so forth. As will be described in more detail below, employing the inventive method, also combinations of the individual solutions may be used.

Various manufacturing technologies can be applied, for example molding, forming, milling or drilling of bulk dielectric, etching or deposition of metal on dielectric substrate, additive (or 3D) manufacturing, ink-jet printing with conductive inks (when losses are of lesser concern). In general, any process suitable for producing the desired pattern of interwoven materials with the required accuracy and repeatability can be used.

The inventive design procedure according to various embodiments involves a number of steps that can be summarized as follows.

First, a holographic pattern is obtained on the selected antenna surface. Second, the continuous hologram is mapped onto the applicable metasurface characteristic (leakage tensor or scattering tensor).

Next, the surface impedance is derived from the latter taking physical constraints into account, e.g., the feasible impedance range on the selected dielectric substrate. The subsequent steps depend on the chosen implementation of the metasurface. If a modulated dielectric or another continuously varying structure is used, the impedance is mapped in the specific variation, e.g., the dielectric thickness. If a discrete variation is used, like sub-wavelength metallic patches printed on a dielectric substrate, then the impedance is discretized by a selected sub-wavelength grid and the impedance variation is linked to the relevant geometrical parameters of individual patches, e.g., area and orientation of the respective patch, by a local periodic full-wave analysis. Therein, parameter variation is controlled at all scales, i.e., at the scale of individual patches and increasingly larger groups, up to the whole surface. Different choices can be made for each level of scale according to antenna requirements, selected grid, and type of patch. In particular, the interplay among grid geometry, feeding wave symmetries and antenna pattern symmetries is important at this stage. The selection between forward-mode and backward-mode leaky-wave structures, when applicable, is an example of this kind of interplay. Similar procedures apply to the other cases.

For instance, if a printed inductive grid is used instead of the capacitive patches, the element-scale parameters will apply to the holes, according to electromagnetic duality. For a filled honeycomb, the grid is clearly fixed, while the variation will be controlled by the dielectric constant of the filling material(s) and possibly their amount.

The first-cut design obtained in this way may then be refined using an iterative process based on a full wave analysis of the complete structure, e.g., using a very fast Method of Moments (MoM) solver.

The first step above may be complemented by a direct simplified or full-wave analysis of the behavior of strips cut across the antenna surface aimed at a better accuracy of the same.

Alternatively, a 3D hologram can be used to derive a suitable surface using additional criteria to identify a proper locus, for instance minimum phase variation or minimum impedance variation or maximum current strength, and then the hologram that is mapped onto the locus (surface). It is worth noting that the hologram may have no modulation, i.e., the required antenna surface may be homogeneous, for instance a sheet of metal. Therefore the procedure can also be used to efficiently design classical antennas in a possibly more effective way. Thereby, the present application allows obtaining a shaped reflector design without resorting to costly numerical optimization.

The process described so far can be applied to both the so-called field and power synthesis cases. In the first case, the desired antenna pattern is known in both amplitude and phase, while in the second case only the amplitude is known and the phase can be determined in several ways including successive projections, non-linear optimization applied to the first step or to the full synthesis and to the subsequent optimization cycles.

Since the operation of modulated metasurfaces is based on sub-wavelength phenomena, modulated metasurfaces can be used in a wide variety of devices and, in particular, can be applied to a large spectrum of antenna types, including completely new ones, which are only feasible using metasurfaces.

Figure 6:
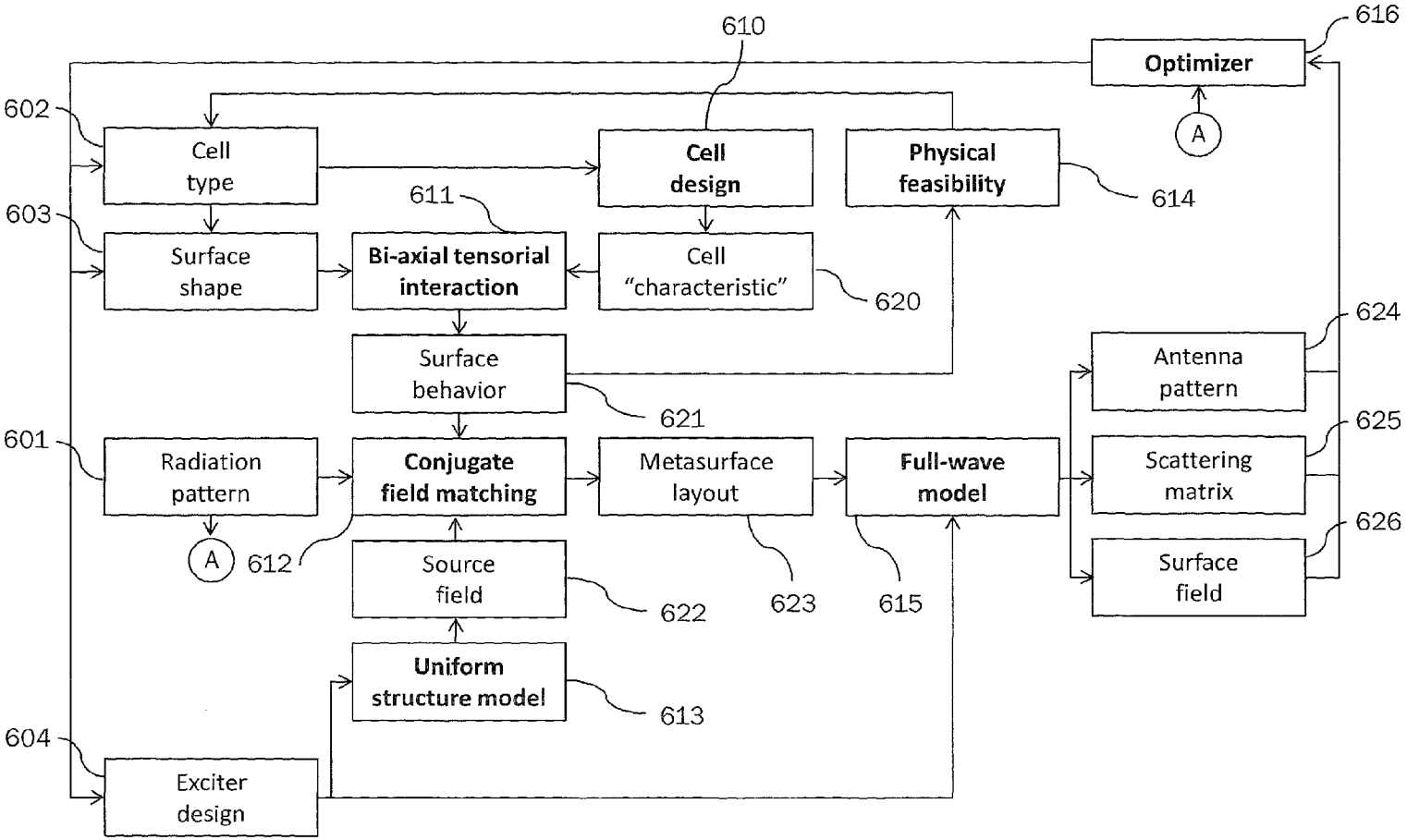
FIG. 6 is an overview of the inventive method.

An overview of the inventive method is provided in FIG. 6. The flow of the design procedure moves roughly from left to right of FIG. 6, wherein boldface font indicates process steps and regular font indicates data that is input to/output by the respective process steps. Global inputs 602, 603, 604 are specified beforehand, at least in the first passes through the procedure in the overall design cycle.

The design procedure begins with the specification of a desired radiation pattern 601. The further inputs, such as the basic metasurface shape 603, the type of cell 602 (in case of a discrete metasurface) or local modulation (in case of a continuous metasurface), and the exciter design 604, need to be defined as well, e.g., based on engineering experience and on the results obtained from previous analyses of similar structures. The step of defining the exciter design 604 can be bypassed by directly specifying the excitation field (incident field) 622, i.e., the source field for the conjugate-matching process 612. Also the surface behavior 621, the third input for conjugate matching, can be directly specified as input, if it can be directly derived from the knowledge of the surface design parameters (e.g., for modulated height dielectrics).

Two sub-processes need to occur in parallel or serially to provide the inputs required by the conjugate field matching procedure except for the desired radiation pattern. The first of these sub-processes relates to defining the metasurface behavior 621 and the second one relates to defining the source field 622.

The first sub-process involves determining the cell design 610 and the computation 611 of the bi-axial tensor behavior of the metasurface considering all its parameters. Determining the cell design 610 yields the cell characteristic 620. Cell design 610 is replaced by local modulation if a continuous metasurface implementation is used. After the surface behavior 621 has been defined, a sanity check 614 is performed in order to verify whether or not the results obtained by the first sub-process are satisfactory, i.e., whether or not they guarantee compliance with the minimum requirements for the physical feasibility of the metasurface antenna.

The second sub-process involves the calculation of the source field 622 on the basis of the exciter design 604 and the model 613 of a uniform metasurface of the selected type. This model is in fact a variation of the one applied to derive the parameterization of the cell behavior, which is illustrated in FIG. 8.

Figure 8:
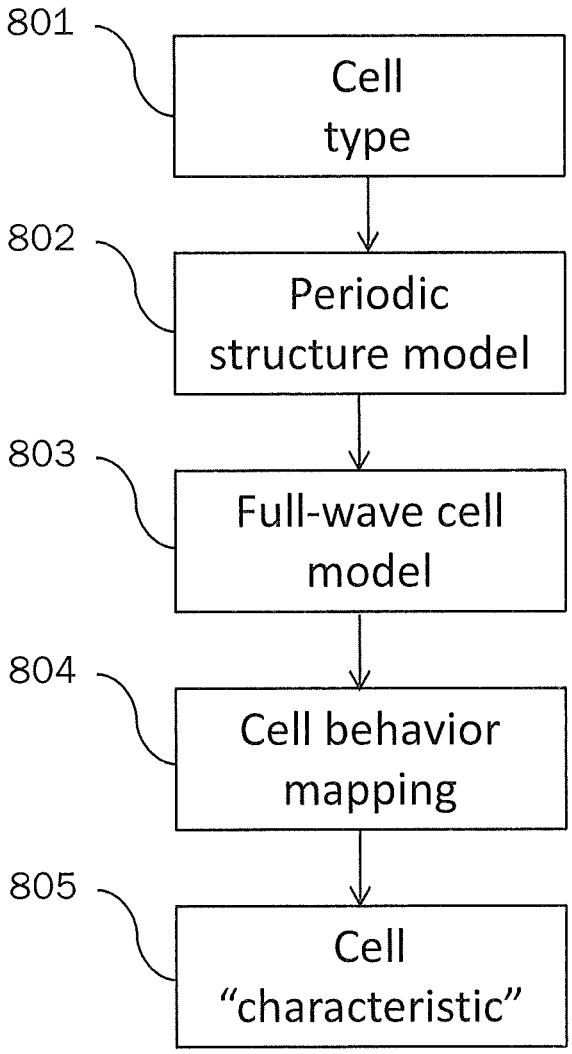
FIG. 8 illustrates a detail of FIG. 6.

As is illustrated in FIG. 8, the cell design 610 in the first sub-process requires two basic steps: the modeling of an infinite and uniform periodic structure 802 based on a single realization of the cell of the given cell type 801 (corresponding to the cell type 602 in FIG. 6), i.e., based on a single set of values for the parameters of the cell of the given cell type 801, and the cell behavior mapping 804. As a reference example, the use of an element printed on a grounded dielectric substrate as metalized area is assumed.

In the step of modeling the infinite and uniform periodic structure 802, assuming the application of full-wave modeling, all cells currently handled are modeled using a periodic method of moments solver. Other methods that could be applied here include, e.g., Finite Difference Time Domain (FDTD) methods, Boundary Element Methods (BEM) or Finite Element Methods (FEM). Fully conductive structures are modeled in a different way from structures containing dielectrics. Without limitation of the present application, the algorithms employed here belong to the class of Electric Field Integral Equation (EFIE) Periodic Method of Moments (MoM) formulations. The algorithm further takes into account the particular periodicity linked to the chosen type of grid such as square, hexagonal or circular.

All of these algorithms are affected by the need to cover a potentially large parametric space to fully characterize the cell behavior as required by the conjugate matching procedure. Such need is reflected in the periodic modeling by the requirement of minimizing the number of unknowns to be solved for in each set of parameter values, a problem which is addressed by using specialized algorithms to reduce the complexity in the solution. Full-domain bases are used where possible, while characteristic modes are applied for more complex geometries. The resulting periodic modeling algorithm can be used as well to compute the source field 622 on the uniform structure starting from the exciter design data 604.

In more detail, in step 802 the Green's dyadic function of the dielectric layer is computed in the spectral domain according to standard practices. The cell metallization is described using either Rao-Wilton-Glisson (RWG) basis functions or specialized, analytical or numerical, global-domain basis functions. Then, the MoM matrix is computed and the relevant linear system is built using the transverse resonance formulation. The impedance values are iteratively computed for a sufficient number of parameter values of the cell of the given cell type 801, iterating the steps of describing the cell metallization, computing the MoM matrix, and solving the relevant linear system if necessary.

The cell behavior mapping 804 uses the information generated by the periodic modeling 802 of the cell to produce a complete mapping while using as little information as possible, i.e., minimizing the number of parameter-value sets. While a brute force approach requires computing all values eventually needed by the conjugate matching, more refined approaches as discussed below reduce the number to just a few sets. The full map is obtained by interpolation, exploiting the mathematical properties (symmetries and regularities) of the integral representation of the relevant fields in proximity of the impedance surface.

Furthermore, this step uses a Pole-Zero Matching algorithm as proposed in Maci, S. et al, "A pole-zero matching method for EBG surfaces composed of a dipole FSS printed on a grounded dielectric slab," Antennas and Propagation, IEEE Transactions on, vol. 53, no. 1, pp. 70-81, January 2005, which allows compressing the overall amount of information to be used in the conjugate matching step when deriving the cell parameter values required for obtaining the desired behavior point by point. It is worth noting that the compression also contributes to reducing the number of sample points needed to produce the complete map, i.e., the number of parameter sets to be computed in the first step. Therefore, its use is important in assuring an efficient and accurate solution for the conjugate matching problem.

Figure 7A:
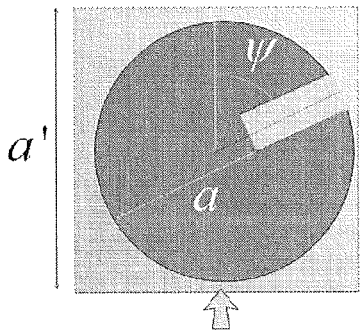
FIG. 7 illustrates different choices of cell types for implementing the determined impedance pattern.
Figure 9:
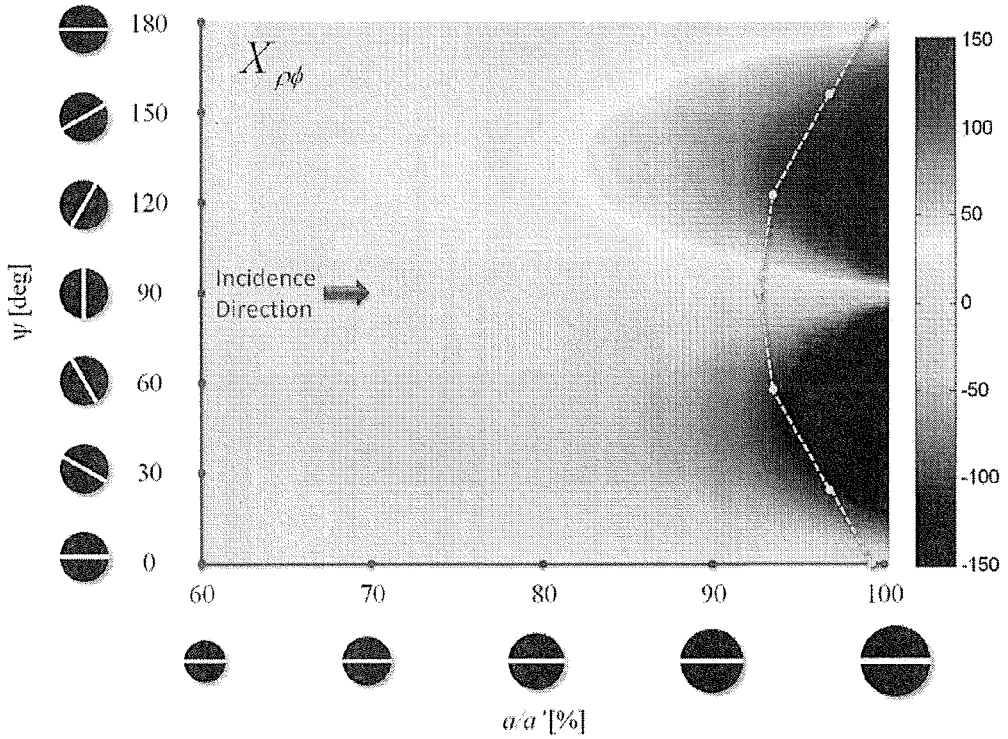
FIG. 9 illustrates a map between cell characteristics and impedance values.

As an outcome, the cell design 610 provides the cell characteristic 805, which corresponds to a map for each component of the surface impedance tensor, indicating a particular value of the respective component for a given set of parameters of the cell. Typically, for a given cell type (e.g., a cell containing a notched circular metallic patch as illustrated in FIG. 7A, which will be described below), a cell is fully characterized for the present purposes by only two parameters (e.g., the angular orientation of the notch and the radius of the circular patch). In this case, the respective map can be represented by a two-dimensional map, as illustrated in FIG. 9.

Returning now to FIG. 6, the overall surface behavior 621 is then derived from the cell characteristic 620 and the surface shape input 603. The algorithm combines the information on the cell (i.e., the map determined by the process of FIG. 8) with the global surface shape to derive an optimum path to be followed on the map of the cell characteristics when generating the layout in the field matching procedure. This path in the space of geometric parameters of the cell enables unique inversion of the map. The determination of the path is based on the specific characteristics of the cell and it is therefore map dependent. For an overview of such a path determination, it is referred to the example under section VI of Minatti et al. 2012.

The determination of the optimum path, which is not necessarily the same for the different elements of the impedance tensor, uses a further dedicated algorithm that determines the best compromise among stability of performances, i.e., minimum gradient, and smoothness of the resulting (sampled) impedance distribution $z_s(\zeta, \eta)$, i.e., minimum variation of all relevant parameters, while achieving the desired impedance dynamics (i.e., allowing for implementation of all values of the respective component of the impedance tensor that are expected to be necessary in realizing the impedance surface). Thus, each path is chosen so that it enables to obtain all presumably desired values of the respective component of the impedance tensor. The paths for the different components of the impedance tensor are related to each other in accordance with relationships between the components, e.g., dictated by symmetry considerations. It is possible to ensure that such paths exists by appropriately adjusting the further parameters of the cell of the given cell type beyond the two parameters that are actually used to characterize the cell.

An alternative approach used in case of complex multi-dimensional maps is to search directly for the path starting from a selected point on the boundary of the space of geometric parameters and following the optimum path, determined according to the above requirements and by repeating the steps of describing the cell metallization, computing the MoM matrix, and solving the relevant linear system on the new sets of values of the geometric parameters determined by the optimization algorithm at each step.

Figure 10:
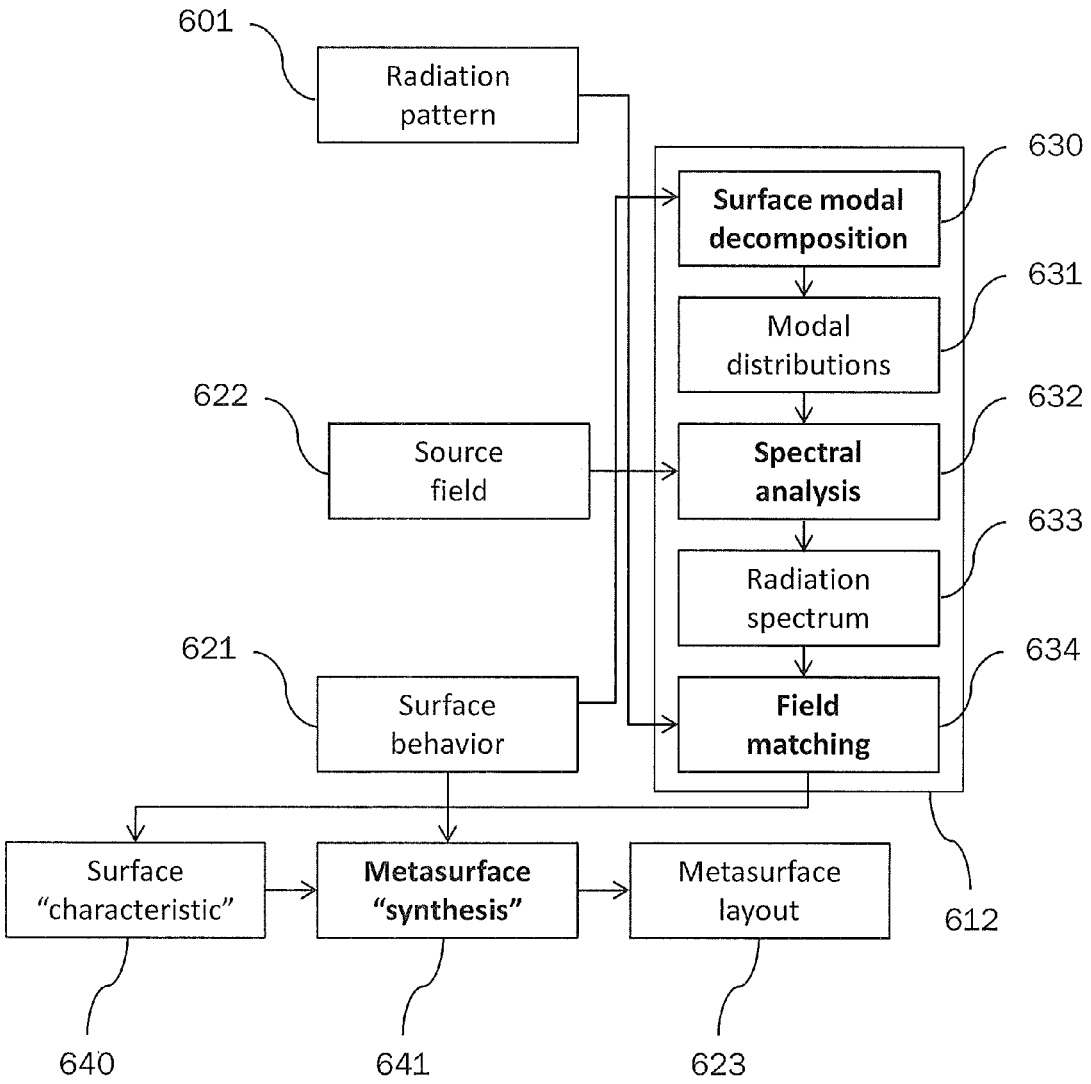
FIG. 10 illustrates another detail of FIG. 6.

The conjugate field matching 612 produces the metasurface layout 623 using the output of the steps discussed so far, namely the source field 622 and the surface behavior 621, in addition to the desired radiation pattern 601. FIG. 10 illustrates additional details of this step, wherein boldface font indicates process steps and regular font indicates data that is input to/output by the respective process steps. The matching occurs in the spectral domain, i.e., using information related to fields observed at a very large distance from the metasurface antenna. Thus, it is not necessary to project the desired field pattern on the aperture, either via a simple back-transformation from far field to near field, if the field is known in amplitude and phase, or via an alternate-projections procedure if only the amplitude is known, as it is usually the case. Instead, when working in the spectral domain it is the source field (incident field) than needs to be transformed to the spectral domain. Yet the algorithmic details of transforming the source field to the spectral domain are quite different from prior art techniques for projecting the desired radiated field onto the aperture of the antenna. It is particularly to be noted that the inventive method and prior art approaches as described tend to deliver different results even for identical configurations.

The surface behavior 621 is first decomposed into a modal representation 630. Several possibilities for the decomposition can be used, such as a decomposition into Zernike polynomials, angular sectors, harmonic functions, Spline wavelets, wherein the particular choice depends also on the basic shape (e.g., round, square, elliptical, etc.) of the metasurface. The resulting modal distribution 631 is then combined with the spectrum of the source field (incident field) 622 to obtain, by means of spectral analysis 632, a spectral representation (radiation spectrum) 633 of a generic field radiated by the surface. At step 634 the latter is then conjugate-matched via a reaction integral to the desired radiated field (desired radiation pattern) 601. The field matching 634 produces the modal coefficients of the surface behavior defining the surface characteristic 640. As matching is performed directly in the spectral domain it offers a much better control of the radiated field (e.g., with regard to angular distribution and polarization) and allows for the design of metasurface antennas with a shaped pattern virtually in a single step.

The following step uses again information about the surface behavior 621, local rather than global in this case, to map the continuous distribution into the proper discrete or continuous layout of the metasurface, according to the selected type of cell.

The generation of the metasurface layout 623 depends on the chosen metasurface implementation. If a modulated dielectric or another continuously varying structure is used, the continuous surface impedance distribution obtained from the field matching 612 is mapped into the specific variation of the structure, e.g., the dielectric thickness modulation giving rise to varying surface impedance for an antenna fed in-plane. If a discrete implementation is used, like sub-wavelength metallic patches printed on a dielectric substrate, then the surface impedance distribution is discretized on the selected sub-wavelength grid and the local surface impedance is linked to the relevant geometrical parameters of individual cells, e.g., area and orientation of the respective metallic patch.

It has to be noted that an alternative path is possible, in parallel to the procedure described above. Field matching on a near-field surface or volume is computed between the source field and the desired radiated field, e.g., using the reaction integral kernel in a point-wise fashion across a volume. The output is then used to derive a suitable surface using additional criteria to identify a proper locus, for instance minimum phase variation, minimum impedance variation or maximum current strength.

It is also worth noting that in special cases the surface identified by the inventive approach may not require any modulation of its characteristics, i.e., the required antenna surface may be homogeneous, for instance a sheet of metal. As a consequence, the procedure can be used to efficiently design classical antennas in a possibly more effective way as a limiting case of a more general class of structures. For instance, a shaped reflector design may be obtained without resorting to costly numerical optimization.

Returning again to FIG. 6, the metasurface layout 623 is an input to the subsequent full-wave modeling 615 of the antenna, which involves several steps. The other input to the full-wave modeling 615 is the exciter design 604. The metasurface layout needs to be transformed into a CAD layout and a suitable mesh generated on it. The same applies for the exciter, unless it is given as a fixed wave pattern as it may happen in the first design attempts. In the full-wave modeling 615, for example the numerical core of the commercial tool ADF-EMS by IDS Ingegneria Dei Sistemi S.p.A. can be used to solve the structure. The output is constituted by the antenna pattern 624, the input characteristics (i.e., the scattering matrix 625) and the surface currents or surface fields 626 (i.e., fields computed on a surface very close to the radiating face of the metasurface), if desired.

All the above quantities can be used in the optimization loop, comparing them to the desired performance according to a suitably defined objective function. In theory, the optimization could individually address the metasurface cells. However this is clearly beyond the capability of current optimization and search algorithms, as the resulting solution space would have tens of thousands dimensions. As a consequence, it is necessary to use a suitable parameterization of the metasurface layout.

The actual algorithm for this purpose includes a specialized Method of Moments formulation addressing the continuous surface impedance, which is used to predict the metasurface behavior and provide feedback for the adjustment of the models and parameters. An internal optimization loop acts on the global surface parameters to find the best solution. This is particularly beneficial as the model used in the Method of Moments algorithm is the same as used for the modal decomposition of the surface.

The metasurface parameter variation is controlled at all scales, from individual cells or local modulation, to the whole surface. Different choices can be made for each level of scale according to antenna requirements, selected grid, type of metasurface, cell shape or modulation type and so on. In particular, the interplay among modulation periodicities, feeding wave symmetries and antenna pattern symmetries is an important aspect in this regard. The selection between forward-mode and backward-mode pseudo-leaky structures, when applicable, is a good example for a choice to be made in accordance with this kind of interplay.

Also, different parameters apply to each metasurface configuration. For instance, if a printed inductive grid is used instead of the capacitive patch layout, the cell-size parameter will apply to the holes instead of the patches, according to electromagnetic duality. For a filled honeycomb, the grid and cell-size is clearly fixed by available products, while the variation is controlled by the dielectric constant of the filling material(s) and possibly their amount. Most of the above is available today only for printed patches and modulated-thickness dielectric configurations. To cover a wide range of configurations, the inventive procedure can be tailored to each case, thus this part of the overall procedure involves a library of functions, which is growing with time following the number of different cases addressed.

In the following, the present application will be described in more detail with reference to FIGS. 1 to 5. For details of the underlying theory of metasurfaces, it is referred again to reference Minatti et al. 2012, which is herewith incorporated by reference.

FIG. 1 illustrates an overall flow of the inventive design procedure. The desired antenna beam $E^r$ (desired scattered field, desired scattered wave or first-type electromagnetic field radiation), i.e., its beam shape and polarization, is an external requirement and an input to the design procedure. The surface shape (surface curvature and surface form, such as circular, square, elliptic, etc.) and the feeding arrangement producing the exciter field $E^i$ (incident field or second-type electromagnetic field radiation) are input parameters that can be chosen—within appropriate boundaries dictated by the main characteristics of the desired scattered field—in accordance with external requirements or individual preference, i.e., the surface shape and the feed arrangement are design parameters. In the above, the desired scattered field $E^r$ corresponds to the radiation pattern 601 in FIG. 6, the incident field $E^i$ corresponds to the source field 622, and the surface shape corresponds to the surface shape 603.

Further design parameters relate to the particular choice of implementation of the impedance surface (cell type 602 and surface shape 603 in FIG. 6), e.g., parameters relating to basic cells, and will be discussed in more detail below. Depending on the particular choice of implementation of the impedance pattern (e.g., by continuous height modulation of a dielectric or by tiling with metallic patches), it is practicable to carry out the inventive design procedure either in a setup in which the surface is treated as a continuous surface or a setup in which the surface is discretized into a plurality of elements of area. First, the continuous case will be described.

Figure 2:
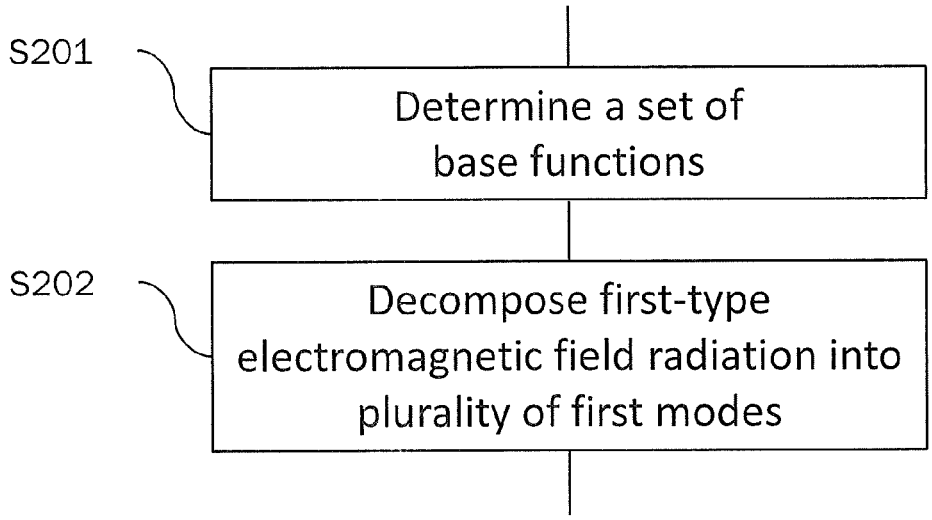
FIG. 2 is a flow chart illustrating a step of the method of FIG. 1.

At step S101, a first modal representation of the desired scattered field $E^r$ (first-type electromagnetic field radiation) is determined by decomposing the desired scattered field $E^r$ in terms of a set of base modes. The desired scattered field $E^r$ may relate to a polarized field (polarized wave) and in particular to a circularly polarized field. Step S101 comprises the sub-steps S201 of determining a set of base modes and S202 of decomposing the desired scattered field $E^r$ in terms of the base modes. Sub-steps S201 and S202 are illustrated in FIG. 2.

At step S201 a set of base modes is generated in accordance with a model function of the position-dependent target impedance $Z_s$ (surface impedance tensor) of the impedance surface $\Sigma(\zeta,\eta)$, $\zeta$ and $\eta$ being coordinates on the surface. It is to be noted that the model function corresponds to the surface behavior 621 in FIG. 6. In a preferred embodiment, the base modes are mutually orthogonal, or even orthonormal.

The model function $z_s$ itself is practicably chosen to reflect a symmetry of the first-type electromagnetic field radiation, but is otherwise arbitrary. The model function $z_s=z_s(\vec{\rho}, Q)$ indicates a desired modulation pattern of the eventual impedance pattern. That is, the model function $z_s$ is a map from the two-dimensional space of coordinates $\vec{\rho}=(\zeta,\eta)$ on the impedance surface to the space of tensorial impedance $z_s$, wherein tensorial impedance is represented by a two-by-two matrix having complex elements. Thus, the model function has one component for each component of the tensorial impedance $z_s$. The model function has two or more as yet not fixed parameters $Q=(\overline{Z}, q_1, \ldots, q_n)$, $\overline{Z}$ being an average impedance of the surface impedance.

Conveniently, the model function is decomposed into the average impedance and a variation, i.e., $Z_s(\vec{\rho},Q)=\overline{Z}(1+\Delta(\vec{\rho},Q))$ using a coordinate system appropriate to the chosen geometry (surface shape, exciter field), e.g., Cartesian or circular. The decomposition may have different forms generally linked to the main symmetry characteristics of the desired radiated field $E^r$ (first-type electromagnetic field radiation). Examples for the decomposition (i.e., the model function) include, but are not limited to 1) sine-like model functions, for which $$Q = \{\overline{Z}, m, 1\}, \text{ and}$$

$$Z_s(\xi, \eta) = \overline{Z}\left(1 + m\cos\frac{2\pi\rho}{1}\right);$$

2) model functions involving phase factors $e^{j\Phi}$, for which $$Q = \{\overline{Z}, m_{-N}, \ldots m_{-1}, m_1, \ldots m_N, l_{-N}, \ldots l_{-1}, l_1, \ldots l_N\}, \text{ and}$$

$$Z_s(\xi, \eta) = \overline{Z}\left(1 + \sum_{n\neq 0} m_n e^{j2\pi\frac{\rho}{l_n}}\right);$$

3) model functions involving Zernike polynomials $Z_n$, for which $$Q=\{\overline{Z}, m_{-N}, \ldots m_{-1}, m_1, \ldots m_N\}, \text{ and}$$

$$Z_s(\zeta,\eta)=\overline{Z}\Sigma_n m_n Z_n(\rho,\Phi);$$

4) model functions involving Spline wavelets of degree q, ${}_q\Psi_n$, for which $$Q=\{\overline{Z}, m_{-N}, \ldots m_{-1}, m_1, \ldots m_N, q\}, \text{ and}$$

$$z_s(\zeta,\eta)=\overline{Z}\Sigma_n m_n\, {}_q\Psi_n(\zeta,\eta); \text{ and}$$

5) model functions involving Spline wavelets of degree q, ${}_q\Psi_n$, and phase factors, for which $$Q=\{\overline{Z}, m_{-N}, \ldots m_{-1}, m_1, \ldots m_N, q\}, \text{ and}$$

$$z_s(\zeta,\eta)=\overline{Z}\Sigma_n m_n\, {}_q\Psi_n(\rho)e^{jn\Phi},$$

wherein it is understood that such a decomposition is performed for each of the components of the surface impedance tensor $z_s$. An example of such a decomposition of the components of the surface impedance tensor $z_s$ will be provided below. As can be seen from the above, one of the parameters Q relates to the average value of the surface impedance, and at least one further parameter relates to a spatial modulation of the surface impedance.

Generation of the set of base modes can proceed in different ways. Their selection is mainly limited by the intended shape of the antenna, and the selected feeding arrangement (e.g., central or edge), which dictates the geometry of the incident field $E^i$. For instance, the base modes may be chosen to correspond to modes that may propagate on the impedance surface if the impedance surface is provided with a position-dependent impedance in accordance with the model function. As indicated above, both the choices of surface shape and feeding arrangement are inherently linked to the symmetries of the desired scattered field $E^r$. Two examples for a selection of the base modes are provided in the following.

First example. Assuming a circular symmetry of the whole antenna structure (circular antenna that is fed from its center), the actually scattered field $E^s$ can be expressed as $$E^s = \sum_n \alpha_n \frac{J_n\left(\sqrt{u^2+v^2}\right)}{\sqrt{u^2+v^2}}, \quad \text{(eq. 1)}$$

where $J_n$ is the Bessel function of order n. Alternatively, $J_n$ can be seen as the combination of a series of "beams" generated by the same aperture excited with different linear phase gradients across it. In the present case, these gradients can be associated to the interaction between the incident field $E^i$ and the surface impedance $z_s$. The resulting expansion is given by $$E^s = \sum_n \gamma_n \frac{J_1\left(\sqrt{(u-u_n)^2+(v-v_n)^2}\right)}{\sqrt{(u-u_n)^2+(v-v_n)^2}} = \sum_n \gamma_n \Upsilon_n(u, v), \quad \text{(eq. 2)}$$

here the pairs $(u_n,v_n)$ represent the directions of the peaks of the individual beams. The basis functions $\gamma_n(u,v)$ are not orthonormal, while they would be in the case of an edge-fed rectangular aperture. If some form of orthogonality is desired, there are two alternatives routes: orthogonalizing the basis via a Gram-Schmidt procedure and normalizing them, or using a dual basis $\overline{\gamma_n}(u,v)$ such that $\langle \gamma_n(u,v), \overline{\gamma_m}(u,v)\rangle=\delta_{nm}$, with $\delta_{nm}$ being the Kronecker symbol.

Second example. Assuming a rectangular structure, the field $E^s$ actually scattered at the surface can be expressed as a combination of localized contributions according to a wavelet scheme. Among the many available options, this can be done using Spline wavelets, which have the property of spanning a variety of degrees of (polynomial) approximation according to the order of the generating Spline function. The scattered field $E^s$ is then expressed at infinity as $$E^s=\Sigma_{m,n}\Psi_{m,n}\hat{\Psi}_{m,n}(u,v) \quad \text{(eq. 3)}$$

where the $\hat{\Psi}_{m,n}(u,v)$ are the Fourier transforms of the wavelet basis, which are known in analytical form. As Spline wavelets on a finite support are by necessity quasi-orthogonal and the same applies to their Fourier transforms, a dual basis is to be used in this case if some form of orthogonality is desirable.

At step S202, the desired scattered field $E^r$ is decomposed in terms of the set of base modes. The decomposition of the desired scattered field $E^r$ is given by $$E^r(u,v)=\Sigma_{p,q}\alpha_{pq}e_{pq}{}^r(u,v), \quad \text{(eq. 4)}$$

where (u,v) are coordinates on an observation surface, the $e_{pq}^{r}(u,v)$ are the base modes, and $\alpha_{pq}$ are expansion coefficients of the desired scattered field $E^r$. Thus, obtaining the first modal representation includes decomposing the first-type electromagnetic field radiation $E^r$ into a plurality of first modes, wherein each of the plurality of first modes corresponds to a respective one of the set of base modes.

In the following, the far-field sphere is assumed as an observation surface, but the inventive design procedure, with the necessary modifications, can be equally well applied for other choices of the observation surface, e.g., a sphere of radius R surrounding the antenna structure.

In case that the required (desired) radiated field $E^r$ is known only in square modulus of the far-field pattern, i.e., as directivity pattern $D^r \propto |E^r|^2$, successive projections are applied using a suitable Fourier basis (e.g., plane, spherical or cylindrical waves) to reconstruct the complete far-field information in amplitude and phase. After an initial reconstruction based on the main geometrical characteristics of the desired metasurface antenna, e.g., diameter or side lengths, the successive projection cycle operates using the field $E^s$ radiated by the structure. The possible radiation from the exciter, i.e., the portion of $E^i$ reaching the far-field is also accounted for in the process by adding it to $E^s$ or subtracting it from $E^r$ according to the type of exciter.

Figure 3A:
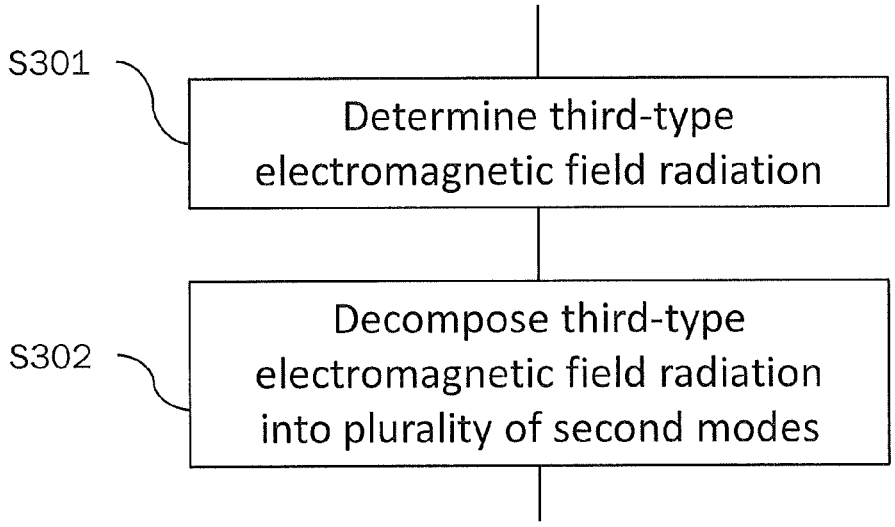
FIGS. 3A, 3B are flow charts illustrating another step of the method of FIG. 1.

At step S102, a second modal representation is determined on the basis of the incident field $E^i$ (exciter field, incident field/wave or second-type electromagnetic field radiation) and the model function. The incident field $E^i$ may be anisotropic with respect to a center of the impedance surface. As is illustrated in FIG. 3A, this step comprises sub-steps S301 of determining an actual scattered field $E^s$ (actual scattered wave or third-type electromagnetic field radiation) and S302 of decomposing the actually scattered field $E^s$ in terms of the base modes.

At step S301, the actual scattered field $E^s$ (third-type electromagnetic field radiation) is determined. The field radiated by the impedance surface depends on the incident field $E^i$ and the surface impedance $z_s$. It is given by $$E^s = \iint_{\Sigma} J_{eq}(\xi, \eta) e^{-jk_0 \cdot r} d\Sigma = \iint_{\Sigma} F(E^i(\xi, \eta), Z_s(\xi, \eta)) e^{-jk_0 \cdot r} d\Sigma = L(E^i, Z_s), \quad \text{(eq. 5)}$$

where $J_{eq}(\zeta, \eta)$ is a current distribution on the impedance surface $\Sigma(\zeta,\eta)$, $\zeta$ and $\eta$ being coordinates on the surface, and $k_0$ is the free-space wave propagation constant.

At step S302, the actual scattered field $E^s$ obtained at step S301 is decomposed in terms of the set of base modes. The decomposition of the actual scattered field $E^s$ is given by $$E^s(u,v)=L(E^i, z_s)(u,v)=\Sigma_{p,q}\beta_{pq}e_{pq}^{s}(u,v), \quad \text{(eq. 6)}$$

where the $\beta_{pq}$ are expansion coefficients of the actual scattered field $E^s$, and the $e_{pq}^{s}(u, v)$ are the base modes in case of orthonormal base modes, or the duals of the respective base modes in case of non-orthonormal base modes. Thus, obtaining the second modal representation includes decomposing the third-type electromagnetic field radiation $E^s$ into a plurality of second modes, wherein each of the plurality of second modes corresponds to a respective one of the set of base modes.

Figure 3B:
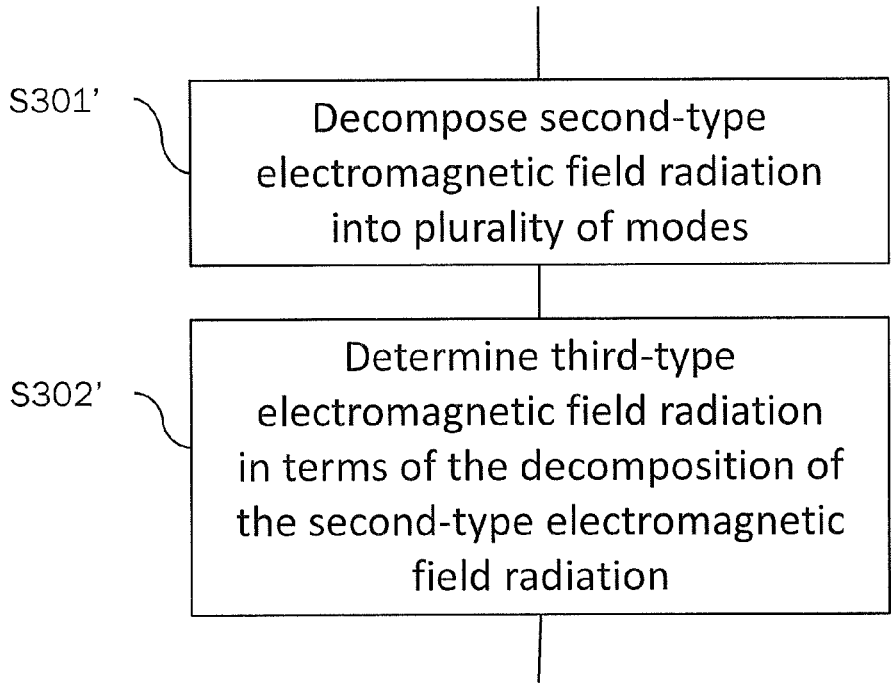

Alternatively, as is illustrated in FIG. 3B, the incident field $E^i$ may be decomposed in terms of the base modes at step S301', and subsequently, at step S302' the actual scattered field $E^s$ may be determined from the decomposition of the incident field $E^i$ in analogy to the above description. In this case, the decomposition of the incident field $E^i$ is given by $$E^i(u,v)=\Sigma_{p,q}\gamma_{pq}e_{pq}^{i}(u,v) \quad \text{(eq. 7)}$$

where the $e_{pq}^{i}(u,v)$ are the base modes, and $\gamma_{pq}$ are expansion coefficients of the incident field $E^i$.

The actual scattered field is then obtained by plugging the decomposition of (eq. 7) into the integral of (eq. 5). The expansion coefficients of the actual scattered field $E^s$ in terms of the base modes obtained in this manner are identical to the expansion coefficients $\beta_{pq}$ obtained via (eq. 6), identical base modes assumed, i.e., if $e_{pq}^{s}=L(e_{pq}^{i}, z_s)$ for all p, q.

Figure 4:
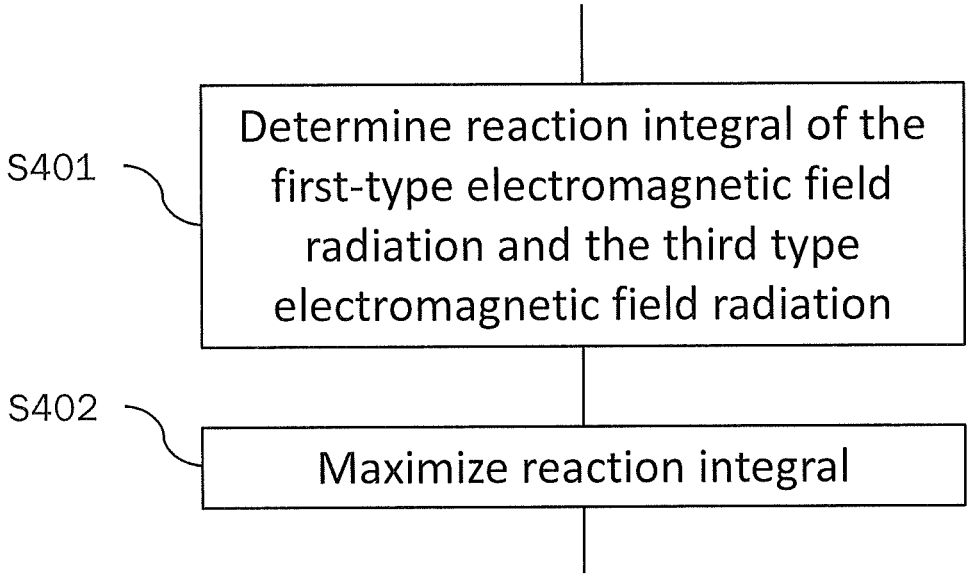
FIG. 4 is a flow chart illustrating another step of the method of FIG. 1.

At step S103 a first position-dependent quantity is determined. The first position-dependent quantity is indicative of the position-dependent target impedance. More specifically, the first position-dependent quantity is obtained on the basis of the first modal representation and the second modal representation by maximizing an overlap between the first modal representation and the second modal representation. Thus, as illustrated in FIG. 4, step S103 comprises sub-steps S401 of calculating a reaction integral (coupling) of the first-type electromagnetic field radiation and the third-type electromagnetic field radiation in terms of the first and second modal decompositions, and S402 of maximizing the reaction integral by determining a set of parameters Q of the model function that maximize the reaction integral.

At step S401, the reaction integral G is calculated, which is given by $$G=\iint_{\Omega}E^s \cdot E^{r*} d\Omega=\iint_{\Omega}L(E^i, z_s)\cdot E^{r*} d\Omega, \quad \text{(eq. 8)}$$

where $z_s$ is the model function of the surface impedance tensor and $E^{r*}$ is the complex conjugate of the desired scattered field.

An important point in the present procedure is the fact that the reaction integral is computed in the spectral domain. Here, this is exemplified as far-field, i.e., directions in real space, but the procedure is not necessarily limited to the far-field as $\Omega$ is actually extended to the full spectral domain (K-space, i.e., frequency domain for spatial frequencies).

As indicated above, the availability of the modal decomposition for the desired scattered field $E^r$ enables expanding the actual scattered field $E^s$ and/or the incident field $E^i$, using either the same basis functions (base modes) as used for $E^s$ and/or $E^i$, if the base modes are orthonormal, or their duals in the opposite case. As indicated above, the (u, v) coordinate pair corresponds to points on the far-field sphere of infinite radius, the forward hemisphere of which has a one-to-one mapping to the unit disk in the space of wave numbers, or spectral domain K.

Evaluating the reaction integral G involves, for each of the set of base modes for which a corresponding first mode in the plurality of first modes and a corresponding second mode in the plurality of second modes exists, calculating an outer product between the corresponding first mode and the corresponding second mode. Thus, an important advantage of this setup is that it the (bi-) orthogonality of the base modes reduces the reaction integral of (eq. 8) to a simple summation of coefficients of the same order. In particular, the intimate link obtained between the three fields involved in the process, namely $E^i$, $E^s$ and $E^r$, enables directly "projecting" the features of the desired scattered field $E^r$ into the characteristic of the impedance distribution $z_s$ for a given incident field $E^i$. Furthermore this "projection" has an essentially analytical form which results in a very fast and direct synthesis process. In a first step of the synthesis process, the series are truncated to one or just a few terms which still results in a very good approximation of the solution, which is then refined by means of an optimization process. This approach intrinsically has a much higher degree of accuracy than prior art approaches, as only the scattering phenomena occurring in the antenna structure and providing by large the dominant contribution to the radiated field are accounted for in the inventive impedance surface model.

The desired surface impedance distribution is then obtained at step S402 by maximizing the coupling between the required and radiated field, i.e., by maximizing the reaction integral G of (eq. 8). More specifically, the parameters Q of the model function $z_s(\zeta,\eta)$ of the surface impedance tensor are determined at this step so as to maximize the reaction integral.

Using the modal expansions obtained at steps S101 and S102 in the reaction integral G, the optimization problem can be reduced to a discrete one. Rewriting the integral G in explicit form yields $$G = \iint_{\Omega} L(E^i, Z_s)\cdot E^{r^*}\,d\Omega = \iint_{\Omega} j2j\frac{e^{-jk_0R}}{R}\hat{r}\times\iint_{\Sigma}\frac{Z_s(\rho)}{Z_0}E^i(\rho)\times\hat{n}e^{jk_0\rho\cdot\hat{r}}d\Sigma\cdot E^{r^*}\,d\Omega, \quad \text{(eq. 9)}$$

where R is the far-field distance, $\hat{r}=(u, v)$ are the far-field directions, $\rho=(\zeta, \eta)$ are the surface coordinates and the form valid for $r\rightarrow\infty$ has been taken for the radiation integral. Assuming a TM propagation on the metasurface (dominant mode), the reaction integral can be recast as $$G = -j\frac{2k_0}{Z_0}\frac{e^{-jkR}}{R}\iint_{\Omega}\hat{r}\times\iint_{\Omega'}\tilde{Z}_s(\omega')E^i_{//}(\hat{r}-\omega')d\Omega'\cdot\sum_{r,s}\alpha^*_{rs}e^{r^*}_{rs}(\hat{r})d\Omega, \quad \text{(eq. 10)}$$

and by inserting the modal decompositions one obtains $$G = -j\frac{2k_0}{Z_0}\frac{e^{-jkR}}{R}\sum_{p,q}\beta_{pq}\sum_{rs}\alpha^*_{rs}\iint_{\Omega}\hat{r}\times\iint_{\Omega'}\tilde{Z}_s(\omega')e^i_{//pq}(\hat{r}-\omega')d\Omega' e^{r^*}_{rs}(\hat{r})\sin\theta d\Omega. \quad \text{(eq. 11)}$$

Decomposing the model function $z_s$ into its average and variation, $z_s(\bar{\rho},Q)=\bar{Z}(1+\Delta(\bar{\rho},Q))$ and using a coordinate system appropriate to the chosen geometry, the reaction integral G is given by $$G = -j\frac{2k_0}{Z_0}\frac{e^{-jk_0R}}{R}\sum_{p,q}\beta_{pq}\sum_{rs}\alpha^*_{rs}\left[\bar{Z}\iint_{\Omega}\hat{r}\times e^i_{//,pq}(\hat{r})e^{r*}_{rs}(\hat{r})\sin\theta d\Omega + \sum_{n\neq 0}m_n\iint_{\Omega}\hat{r}\times\iint_{\Omega'}\Delta\bar{Z}_s(\omega')e^i_{pq}(\hat{r}-\omega')e^{r^*}_{rs}(\hat{r})\sin\theta d\Omega\right], \quad \text{(eq. 12)}$$

-continued wherein it is understood that a decomposition of the model function $z_s$ is performed for each of the four components of the surface impedance tensor. Using for instance $$Z_s(\xi,\eta) = \bar{Z}\left(1+\sum_{n\neq 0}m_n e^{j2\pi\frac{\rho}{l_n}}\right)$$

corresponding to expansion 2) described above, this can be finally simplified into $$G = -j\frac{2k_0\bar{Z}}{Z_0}\frac{e^{-jk_0R}}{R}\left[\sum_{p,q}\beta_{pq}\sum_{rs}\alpha^*_{rs}\gamma^0_{pqrs} + \sum_{n\neq 0}m_n\sum_{p,q}\beta_{pq}\sum_{rs}\alpha^*_{rs}\gamma^n_{pqrs}(u,w)\right], \quad \text{(eq. 13)}$$

where the first summation introduces a constant offset, while the second is actually responsible of the shaping of the radiated beam.

A similar result is obtained for TE propagation, thus covering the complete spectrum of possibilities.

Another important point in the present inventive procedure is that the use of the combined series allows the computation of G in a way largely independent from the specific antenna design, even more when considering the link to a full series representation of the impedance tensor $z_s$. It is noted that using expansions 4) and 5) for the surface impedance tensor $z_s$ has not been possible in prior art approaches attempting to design an impedance surface.

The vectorial coefficients $\gamma_{pqrs}{}^n$ (eq. 13) can be computed once the field and impedance representations have been selected. Since the coefficients $\alpha_{ij}$ are known as well, maximizing the reaction integral G is possible, thereby obtaining the optimum values for the parameters Q, i.e., $\bar{Z}$, $m_n$, n=−N, . . . N and $l_n$, n=−N, . . . N, with N selected according to needs in the present example.

It is to be noted that the present application is not limited to expansion 2) for the surface impedance tensor $z_s$ that has been chosen above as an example. In fact, expansion 2) has been found by the inventors to be not the most efficient option and is convenient mainly for very large structures featuring a slow decay of the surface wave due to radiation via the leaky-wave excitation mechanism implied by the modulation of the surface impedance tensor.

The actual process of maximizing the reaction integral G can be performed by conventional methods that are known to the expert of skill in the art and will not be described here. In the process, boundary conditions for the average impedance $\bar{Z}$ stemming from a particular choice of implementation of the impedance surface can be taken into account. Once the parameters Q are fixed by this process, also the model function is fixed. The model function of the surface impedance tensor $z_s$ indicates the desired target impedance for the impedance surface (first position-dependent quantity).

At step S104, a second position-dependent quantity indicative of geometric characteristics of the impedance surface is determined on the basis of the first position-dependent quantity and a relationship between geometric characteristics of the impedance surface and corresponding impedance values. The second position-dependent quantity is the desired impedance pattern of the impedance surface (i.e., the metasurface layout 623 in FIG. 6).

In the above, a model function $z_s(\vec{\rho}, Q)$ has been introduced. On the other hand, the surface impedance tensor depends on a set of parameters characterizing the impedance surface, linked to geometry and physical characteristics, e.g., the (equivalent) material permittivity or permeability. Thus, $z_s=z_s(C)$, where $C=\{c_1, c_2, c_3 \ldots\}$ is a set of parameters characterizing the impedance surface.

As indicated above, in the case of a continuous impedance surface, the surface characteristics $C=\{c_1, c_2, c_3, \ldots\}$ of the impedance surface (indicating a modulation of the parameters $c_i$) can relate to material permittivity, permeability, or a thickness of the dielectric material. For the case of a discretized, i.e., patterned or tiled impedance surface, the surface characteristics is replaced by the (local) surface characteristics $C=\{c_1, c_2, c_3, \ldots\}$ of the impedance surface which can relate to, e.g., an area of a metallic patch in the respective cell, or an orientation of the metallic patch. Clearly, for each of possible implementations of the impedance surface, a relationship between (local) surface characteristics $C=\{c_1, c_2, c_3, \ldots\}$ and corresponding (local) impedance values exists.

In the present description, the surface impedance is linked to C via the parameters $Q=\{\overline{Z}, q_1, q_2, q_3 \ldots\}$ which in this sense are intermediate parameters. In other words, the values of the parameters C at each point on the impedance surface define the surface impedance tensor $z_s$ which is parameterized by the model function and the set of parameters Q. This treatment allows to better separate the two components of the inventive design procedure, namely that of determining a target surface impedance tensor and choosing a physical implementation of the target surface impedance tensor in terms of geometric characteristics of the impedance surface. In the above, the parameters Q are defined on the whole surface $\Sigma$ while the parameters C are defined locally.

This relationship between C and $z_s$ allows to define a map $z_s=\Psi(C)$ linking the parameters characterizing the impedance surface to values of the surface impedance tensor $z_s$. It is to be noted that the map $\Psi(C)$ corresponds to the cell characteristics 620 in FIG. 6 (although the term cell characteristics might not be completely adequate in the case of a continuous impedance surface). Defining the map $\Psi(C)$ can be achieved in a number of different ways: by analytical considerations, which is possible for the simplest cell geometries, by full-wave modeling, which requires a dedicated algorithm based on spectral-domain method of moments (MoM), and also by measurement and interpolation.

In the present example, having obtained the values of the expansion coefficients Q in $$Z_s(\xi, \eta) = \overline{Z}\left(1 + \sum_{n\neq 0} m_n e^{j2\pi \frac{\rho}{l_n}}\right),$$

it is then possible to derive the values of the surface characteristics $C=\{c_1, c_2, c_3, \ldots\}$ by inverting the relevant map $z_s=\Psi(C)$. Since the map is not one-to-one, the step of inverting the map requires the determination of an optimal path in the space of surface characteristics C for each component of the surface impedance tensor $z_s$, as indicated above.

The final result of this process is the metasurface layout (metasurface layout 623 in FIG. 6) defined by $C=\{c_1(\zeta,\eta), c_2(\zeta,\eta), c_3(\zeta,\eta), \ldots\}$, i.e., a set of surface parameters $c_1, c_2, c_3, \ldots$ for each position $(\zeta,\eta)$ on the impedance surface.

The process of inverting the map $z_s=\Psi(C)$ and determining the surface characteristics $C=\{c_1, c_2, c_3, \ldots\}$ will be described in more detail below with reference to the case of a discretized impedance surface.

At step S105, the impedance surface is provided with the desired impedance pattern by mechanical manipulation of the impedance surface, e.g., by drilling, milling, printing of metallic patches, mounting of small metallic pins, etc.

The above description of the inventive method has assumed a continuous treatment of the antenna surface. Alternatively, the impedance surface can be discretized into a plurality of elements of area (patches or cells) for reasons of computational efficiency, and especially in cases in which the chosen implementation of the surface impedance is planned to be performed by means of tiling the antenna surface.

In this case, the inventive design procedure comprises an additional step S106 of dividing the impedance surface into a plurality of elements of area. This step involves choosing a partition $\Gamma=\{\Gamma_k, k=1,2, \ldots K\}$ of the impedance surface $\Sigma$ such that $\Gamma_k \subset \Sigma$ and $\cup\Gamma_k=\Sigma$. Unless the particular choice of the partition has an impact on the choice of the set of base modes, step S106 can be inserted into the process flow illustrated by FIG. 1 at any position before step S104.

As indicated above, for an impedance surface divided into a plurality of elements of area, the surface impedance tensor can be implemented by tiling the impedance surface with a plurality of cells. One example for cells that may be used in this context relates to printed metallic patches as illustrated in FIGS. 7A to 7D.

FIG. 7A illustrates a (square) cell with a circular metallic patch having a rectangular notch reaching from a circumference of the patch towards the center of the patch. Design parameters of the cell are the diameter a of the patch (or rather the ratio a/a', where a' is the size of the cell itself) and the orientation of the notch which is indicated by an angle $\Psi$ with respect to a fixed reference direction.

Figure 7B:
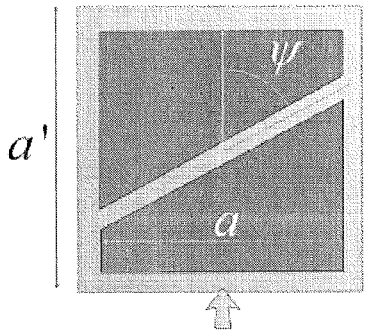

FIG. 7B illustrates a (square) cell with a square metallic patch having a cut-out reaching from one side of the patch to the opposite side (or from a corner of the patch to the opposite corner) passing through the center of the patch. Design parameters of this cell are the length a of the sides of the square patch (or rather the ratio a/a', where a' is the size of the cell itself) and the orientation of the cut-out which is indicated by an angle $\Psi$ with respect to a fixed reference direction.

Figure 7C:
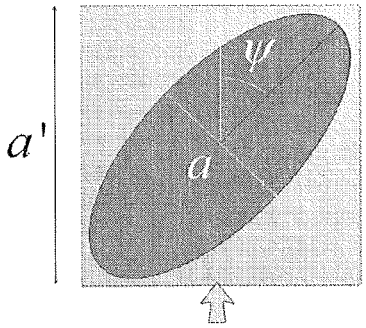

FIG. 7C illustrates a (square) cell with an elliptic metallic patch. Design parameters of this cell are, e.g., the length a of the shorter semi-axis of the elliptic patch (or rather the ratio a/a', where a' is the size of the cell itself) and the orientation of the long semi-axis of the elliptic patch which is indicated by an angle $\Psi$ with respect to a fixed reference direction.

Figure 7D:
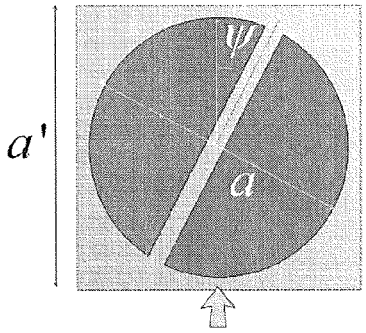

FIG. 7D illustrates a (square) cell with a circular patch having cut-out along a diameter of the circular patch. Design parameters of this cell are the diameter a of the circular patch (or rather the ratio a/a', where a' is the size of the cell itself) and the orientation of the cut-out which is indicated by an angle $\Psi$ with respect to a fixed reference direction.

Returning now to the description of step S106, the relevant map that links surface characteristics $C=\{c_1, c_2, c_3, \ldots\}$ to values of the surface impedance tensor $z_s$ is given by $\Psi(C, k)$. It is to be noted that for a given partition $\Gamma$, according to the present application a different implementation of the surface impedance tensor (i.e., for instance a different cell type) may be chosen for each element of area $\Gamma_k$ of the partition $\Gamma$. For example, cells of cell type illustrated in FIG. 7A could be used for some elements of area of the partition $\Gamma$, whereas cells of cell type illustrated in FIG. 7B could be used for the remaining elements of area of the partition $\Gamma$. In more detail, the map $\Psi(C, k)$, for each element of area $\Gamma_k$ links the parameters of the respective cell (geometric characteristics) to values of the components of the impedance tensor $z_s$. In other words, the map $\Psi(C, k)$ relates to a relationship between geometric characteristics of the elements of area and corresponding impedance values.

Thus, as an example, the geometric characteristics of at least a subgroup of the plurality of elements of area may respectively relate to a configuration of a conducting structure of predetermined shape provided on a dielectric material. Alternatively or in addition, the geometric characteristics of at least a subgroup of the plurality of elements of area may respectively relate to a thickness of a dielectric material. Further alternatively or in addition, the geometric characteristics of at least a subgroup of the plurality of elements of area may respectively relate to a configuration of one or more openings in a metal layer. Yet further alternatively or in addition, the geometric characteristics of the impedance surface may relate to a thickness of a dielectric material.

Then, for each element of area the geometric characteristics of the respective element of area are determined on the basis of the value of the tensorial impedance (indicated by the first position-dependent quantity) at the position of the element of area, by referring to the respective map $\Psi(C, k)$, in the same manner as described above in connection with the continuous case. Therein, for instance an average value of the tensorial impedance over the area of the element of area, or the particular value of the tensorial impedance at the center of the element of area may be taken as the tensorial impedance at the position of the element of area. In this way, similarly to the continuous case a second position-dependent quantity indicative of geometric characteristics of the impedance surface is determined on the basis of the first position-dependent quantity and a relationship between geometric characteristics of the impedance surface and corresponding impedance values. The second position-dependent quantity is the desired impedance pattern of the impedance surface. In other words, obtaining the second position-dependent quantity in the present case comprises, for each of the plurality of elements of area, obtaining geometric characteristics of the element of area on the basis of the first position-dependent quantity and the relationship between geometric characteristics of the elements of area and the corresponding impedance values.

Figure 5:
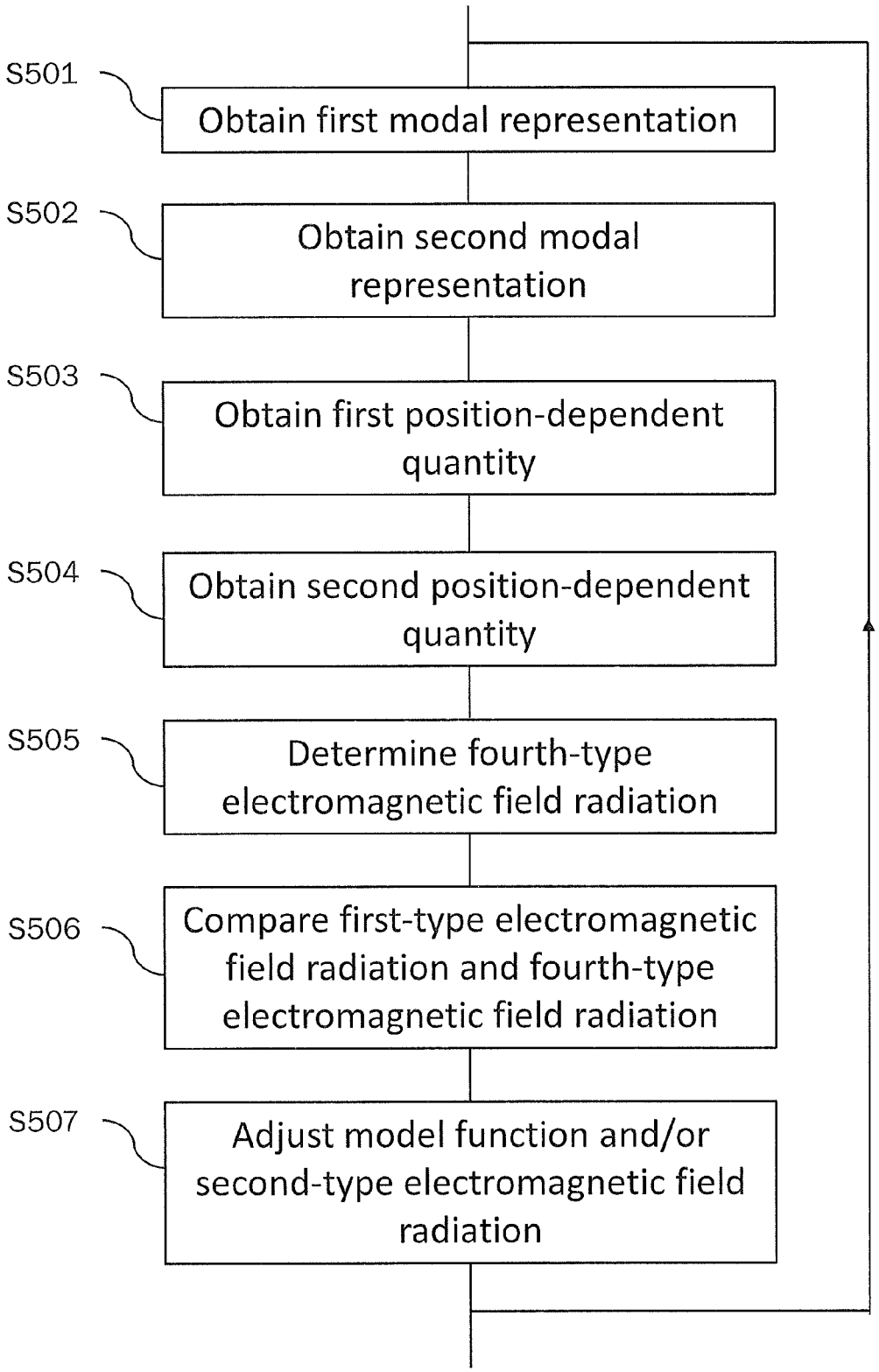
FIG. 5 is a flow chart illustrating a modification of the method for designing a surface pattern for an impedance surface of FIG. 1.

FIG. 5 illustrates a modification of the method for designing a surface pattern for an impedance surface described with reference to FIG. 1. Steps S501 to S504 correspond to steps S101 to S104 of FIG. 1. However, instead of providing the impedance surface with the desired impedance pattern by mechanical manipulation of the impedance surface, at step S505 a field (fourth-type electromagnetic field radiation) that would be radiated by an impedance surface provided with the impedance pattern obtained at step S504 is determined. Thus, this step takes into account the actual implementation of the surface impedance tensor determined at step S503.

At step S506, the fourth-type electromagnetic field radiation is compared to the desired scattered field $E^r$ (first-type electromagnetic field radiation). In other words, the step comprises comparing the first-type electromagnetic field radiation to the fourth-type electromagnetic field radiation that would be radiated by the impedance surface provided with the determined surface pattern in reaction to being irradiated by the second-type electromagnetic field radiation. In case of a deviation between the first- and fourth-type electromagnetic field radiations beyond a given margin, any or all of the inputs to the design procedure are adjusted, such as the chosen model function, the exciter structure (resulting in a modification of the incident field), the shape of the metasurface, etc.

After adjustment of the inputs to the design procedure, the flow proceeds to step S501 for a further cycle of the design procedure in order to obtain an adjusted surface pattern. Subsequent to steps S501 to S504 of this further cycle, either a step corresponding to S105 of providing the impedance surface with the desired impedance pattern (surface pattern) by mechanical manipulation of the impedance surface may be performed, or instead, by also performing steps S505 and S506 again, a third cycle of the design procedure may be run through. The design procedure can be repeated until satisfactory agreement between the first- and fourth-type electromagnetic field radiations is reached. It is however to be noted that the inventive method is very close to having one-shot capability, so that for most configurations a satisfactory result is obtained already after the first cycle of the design procedure.

Next, a specific example in which the inventive design procedure can be employed will be described. For this example, a metasurface antenna on a low earth orbit (LEO) satellite is considered. The satellite can be assumed to be visible from an observation point on the earth surface if it has a minimum elevation angle $\gamma_e=10°$. Requiring a uniform power density for every observation point on the earth surface with an elevation angle greater than $\gamma_e$, i.e., requiring a so-called Isoflux pattern, a scattered field (first-type electromagnetic field radiation) is required which has a gain profile $G(\theta, h)$ given by $$G(\theta, h) = \frac{4\pi g^2(\theta, h)}{\iint_\Omega g^2(\theta, h)d\Omega}, \quad \text{(eq. 14)}$$

wherein $\theta$ is an angle with respect to the normal of the metasurface antenna, h is a distance from the metasurface antenna, and $$g(\theta, h) = \begin{cases} |\cos\theta|\sigma - \sqrt{1-\sigma^2\sin^2\theta} & \text{for } \theta < \theta_e \\ 0 & \text{for } \theta > \theta_e \end{cases}, \quad \text{(eq. 15)}$$

with $\sigma=(1+h/R_e)$ and $\theta_e=\sin^{-1}(1/\sigma)-\gamma_e$, $R_3$ being the earth radius.

The gain profile $G(\theta, h)$ defines the shape of the first-type electromagnetic field radiation. The requirement imposed by the gain profile $G(\theta, h)$ is extremely difficult to satisfy using prior art design methods as a significant portion of the radiation needs to be spread over a very large angular region.

Moreover, in the framework of the present application, circular polarization of the radiated beam can be achieved by allowing for an anisotropic surface pattern and providing a metallic excitation patch at the center of the metasurface antenna that is excited in sequential rotation by four pins displaced symmetrically with respect to the center of the excitation patch.

A possible decomposition of the surface impedance tensor (i.e., model function) in the present example is given by $$Z_{\rho\Phi}=jX_s m' \sin(K\rho), \quad \text{(eq. 16)}$$

$$X_{\rho\rho}=X_s(1+m \cos(K\rho) \quad \text{(eq. 17)}$$

$$X_{\Phi\Phi}=X_s(1-m \cos(K\rho)) \quad \text{(eq. 18)}$$

where $X_S$ is the average reactance value on the impedance surface, m,m'<1 are modulation indices, and K=2π/d, with d the period of the modulation. The surface impedance tensor $z_s$ is given by $$Z_s = \begin{pmatrix} jX_{\rho\rho} & Z_{\rho\phi} \\ Z_{\phi\rho} & jX_{\phi\phi} \end{pmatrix}. \quad \text{(eq. 19)}$$

Equations (eq. 16) to (eq. 18) indicate that different decompositions (of the same type however) are chosen for the components of the surface impedance tensor $z_s$ in accordance with the symmetries of the surface impedance tensor. However, the present application is not limited to the above decomposition, and deviating from the above example, also more complex decompositions out of the above list of model functions 1) to 5), or altogether different decompositions may be chosen in the context of the present application.

Prototypes have been realized of the basic (flat) modulated surface excited by a surface wave travelling across it (known as holographic and metasurface antennas in the literature). These prototypes have demonstrated the possibility of controlling the shape and polarization of the radiated beam. Prototypes for both the modulated dielectric thickness and the single-layer metalized patches implementations have been realized, and spot beam and shaped beams have been demonstrated. Computer modeling has been used to assess the feasibility of further configurations.

The behavior of the metasurface in scattering mode, i.e., under out-of-plane illumination, has been simulated for 45° and 90° incidence showing the ability to control the phase of the scattering tensor and accordingly, the phase and polarization of the scattered field. The significant dependence of the phase change in the scattering tensor with the angle of incidence of the incident wave and the surface modulation are a clear indication of the excitation of travelling waves, which is well known and has been proven for similar types of structures, e.g., frequency selective surfaces.

These tests on prototypes have shown both the exceptional predictive power of the synthesis part and the high accuracy of the dedicated full-wave models.

Further, as indicated above it has been found that the inventive design procedure comes very close to a one-shot design capability, i.e., the accuracy is such that the metasurface antenna can be realized without further iterations, at least for the configurations tested so far.

Features, components and specific details of the structures of the above-described embodiments may be exchanged or combined to form further embodiments optimized for the respective application. As far as those modifications are readily apparent for an expert skilled in the art, they shall be disclosed implicitly by the above description without specifying explicitly every possible combination, for the sake of conciseness of the present description.

The invention claimed is:

1. A method for designing a surface pattern for an impedance surface which, if provided on said impedance surface, results in a position-dependent target impedance of said impedance surface, and the impedance surface having the position-dependent target impedance radiates a desired first-type electromagnetic field radiation in reaction to being irradiated by a second-type electromagnetic field radiation, the method comprising:

determining a first modal representation on the basis of the first-type electromagnetic field radiation in terms of a set of base modes that are chosen in accordance with a model function of the position-dependent target impedance;

determining a second modal representation on the basis of the second-type electromagnetic field radiation and the model function in terms of the set of base modes;

obtaining a first position-dependent quantity indicative of the position-dependent target impedance on the basis of the first modal representation and the second modal representation by determining values for a plurality of parameters of the model function for maximizing an overlap between the first modal representation and the second modal representation; and determining, as the surface pattern, a second position-dependent quantity indicative of geometric characteristics of the impedance surface on the basis of the first position-dependent quantity and a relationship between geometric characteristics of the impedance surface and corresponding impedance values.

2. The method according to claim 1, wherein obtaining the first position-dependent quantity comprises:

calculating a reaction integral of the first-type electromagnetic field radiation and a third-type electromagnetic field radiation, that would be radiated by an impedance surface having a position-dependent impedance in accordance with the model function and being irradiated by the second-type electromagnetic field radiation; and maximizing the reaction integral.

3. The method according to claim 1, further comprising a step of partitioning the impedance surface into a plurality of elements of area, wherein the relationship between geometric characteristics of the impedance surface and corresponding impedance values is a relationship between geometric characteristics of the elements of area and corresponding impedance values; and wherein obtaining the second position-dependent quantity comprises, for each of the plurality of elements of area, obtaining geometric characteristics of the element of area on the basis of the first position-dependent quantity and the relationship between geometric characteristics of the elements of area and the corresponding impedance values.

4. The method according to claim 1, further comprising:

determining the set of base modes so that each of the base modes may propagate on the impedance surface if the impedance surface is provided with a position-dependent impedance in accordance with the model function.

5. The method according to claim 2, wherein obtaining the first modal representation includes decomposing the first-type electromagnetic field radiation into a plurality of first modes, wherein each of the plurality of first modes corresponds to a respective one of the set of base modes; and obtaining the second modal representation includes decomposing the third-type electromagnetic field radiation into a plurality of second modes, wherein each of the plurality of second modes corresponds to a respective one of the set of base modes.

6. The method according to claim 5, wherein obtaining the first position-dependent quantity comprises, for each of the set of base modes for which a corresponding first mode in the plurality of first modes and a corresponding second mode in the plurality of second modes exists, calculating an outer product between the corresponding first mode and the corresponding second mode.

7. The method according to claim 1, wherein one of the plurality of parameters of the model function relates to a period of spatial modulation of the position-dependent target impedance on the impedance surface.

8. The method according to claim 1, wherein the model function of the position-dependent target impedance relates to a decomposition of the position-dependent target impedance into a plurality of terms, each relating to a spline wavelet.

9. The method according to claim 1, wherein the model function of the position-dependent target impedance relates to a decomposition of the position-dependent target impedance into a plurality of products of spline wavelets and phase factors.

10. The method according to claim 1, wherein the position-dependent target impedance is of tensorial type.

11. The method according to claim 1, wherein the first-type electromagnetic field radiation is circularly polarized.

12. The method according to claim 1, wherein the second-type electromagnetic field radiation is anisotropic with respect to a center of the impedance surface.

13. The method according to claim 1, wherein the geometric characteristics of at least a subgroup of the plurality of elements of area respectively relate to a configuration of a conducting structure of predetermined shape provided on a dielectric material.

14. The method according to claim 3, wherein the geometric characteristics of at least a subgroup of the plurality of elements of area respectively relate to a thickness of a dielectric material.

15. The method according to claim 3, wherein the geometric characteristics of at least a subgroup of the plurality of elements of area respectively relate to a configuration of one or more openings in a metal layer.

16. The method according to claim 1, wherein the geometric characteristics of the impedance surface relate to a thickness of a dielectric material.

17. The method according to claim 1, further comprising:

comparing the first-type electromagnetic field radiation to a fourth-type electromagnetic field radiation would be radiated by the impedance surface provided with the determined surface pattern in reaction to being irradiated by the second-type electromagnetic field radiation;

adjusting at least one of the model function of the position-dependent target impedance and the second-type electromagnetic field radiation; and repeating the steps according to claim 1 to obtain an adjusted surface pattern.

* * * * *